US007708675B2

(12) United States Patent
Miskech

(10) Patent No.: US 7,708,675 B2
(45) Date of Patent: May 4, 2010

(54) EXERCISE APPARATUS AND METHOD OF USE OF AN EXERCISE APPARATUS

(76) Inventor: Peter Miskech, 2158 Willow Leaf Dr., Rochester Hills, MI (US) 48309

( * ) Notice: Subject to any disclaimer, the term of this patent is extended or adjusted under 35 U.S.C. 154(b) by 5 days.

(21) Appl. No.: 12/070,485

(22) Filed: Feb. 19, 2008

(65) Prior Publication Data

US 2009/0209397 A1 Aug. 20, 2009

(51) Int. Cl.
*A63B 26/00* (2006.01)

(52) U.S. Cl. ..... 482/142; 482/140

(58) Field of Classification Search ..... 482/92–100, 482/140, 142, 148

See application file for complete search history.

(56) References Cited

U.S. PATENT DOCUMENTS

| | | | | |
|---|---|---|---|---|
| 5,044,631 | A * | 9/1991 | Jones | 482/138 |
| 7,048,677 | B2 * | 5/2006 | Mackert et al. | 482/102 |
| 7,357,764 | B2 | 4/2008 | Stearns | |
| 7,476,188 | B2 * | 1/2009 | Perez, Jr. | 482/142 |
| 2002/0119871 | A1 | 8/2002 | Fulks | |
| 2003/0087736 | A1 * | 5/2003 | Carter et al. | 482/142 |
| 2003/0087737 | A1 * | 5/2003 | Studdard | 482/142 |
| 2003/0114281 | A1 * | 6/2003 | Mackert et al. | 482/123 |
| 2004/0029688 | A1 * | 2/2004 | Webber et al. | 482/142 |
| 2008/0004166 | A1 * | 1/2008 | Oren et al. | 482/142 |
| 2008/0064577 | A1 * | 3/2008 | Pederson et al. | 482/140 |
| 2008/0076649 | A1 * | 3/2008 | Chen | 482/140 |
| 2008/0085822 | A1 * | 4/2008 | Webb et al. | 482/140 |
| 2008/0096742 | A1 * | 4/2008 | Garner | 482/140 |
| 2008/0207412 | A1 * | 8/2008 | Lin | 482/140 |

* cited by examiner

*Primary Examiner*—Lori Baker

(57) ABSTRACT

An exercise apparatus including a rigid frame assembly, a selectively rotatable seat assembly coupled to the rigid frame assembly, a pair of selectively movable actuator arm assemblies coupled to the selectively movable seat assembly by a plurality of vertical beams, a back pad assembly coupled to the plurality of vertical beams, and a high tension cable coupled to the pair of selectively movable actuator assemblies. The selectively movable actuator arm assemblies are further coupled to the selectively movable seat assembly, where a movement of the selectively movable actuator arm assemblies in a first direction causes the seat assembly to rotate in a second direction.

7 Claims, 21 Drawing Sheets

EXERCISE APPARATUS AND METHOD OF USE OF AN EXERCISE APPARATUS

FIELD OF THE INVENTION

The present invention generally relates to an exercise apparatus and method of use of an exercise apparatus, and more particularly, to an exercise apparatus which strengthens, tones, and stretches certain muscles of the body in a tensile mode while concomitantly reducing the potentiality of bodily injury. The present invention also provides a method of use of the exercise apparatus.

BACKGROUND OF THE INVENTION

Conventional exercise equipment, such as and without limitation, free weights, universal machines (i.e., an exercise machine which incorporates several exercise assemblies within one machine), and/or the like are conventionally used in order to strengthen and/or tone various muscles of a body. Oftentimes, the conventional exercise equipment necessitates a relatively large amount of athleticism and dexterity in order to utilize the equipment in a safe and designed manner.

For example and without limitation, conventional free weights require a user to lift a certain amount of weight which is attached to a bar. Typically, the user must squat down (i.e., bending at the knees and keeping a straight back), grasp the bar having the weight attached thereto, utilize the various muscles in the legs, thighs, and buttocks, as well as the shoulders, arms, hands, chest, and back to hold, support, and lift the weight off of the ground or rack while concomitantly utilizing the same muscles to maintain balance and correct form (i.e., there are many different forms to safely lift weight and, each of which are solely dependant upon the exercise) in order not to pull or tear a muscle, pinch or damage a nerve, tear or sprain a tendon or ligament, and/or even break a bone.

Yet further, other conventional universal machines typically require a user to freely stand or sit/lay upon a seat/bench. Although sitting or lying does not require a user to squat to pickup the weight as mentioned above, the user must also utilize the aforementioned muscles to support, stabilize, and lift/pull/push the weight in a designed manner in order to tone or strengthen muscles. Substantially any exercise involving the lifting of weight places a larger than normal amount of stress (i.e., a normal amount of stress being the amount of stress upon the body while the body is not lifting weight) upon the muscles, joints, tendons, ligaments, and the like. Therefore, lifting weights of any kind (e.g., free weights, universal machine weights, and/or the like) requires a great amount of athleticism, dexterity, and even initial strength.

Moreover, the lifting of weights or even the lifting of one's own body (i.e., push-ups, chin-ups, sit-ups, and/or the like) does not typically strengthen the muscles in the abdomen and back without putting the user at risk of injury to these aforementioned muscles. Strengthening of the back and abdominal muscles can only be accomplished in a tensile mode or motion, whereas lifting weights is done in a compression mode or motion (i.e., a tensile mode is a substantially opposite motion than that of a compression mode).

Lastly, a compression mode or motion, as discussed above, can be very harmful to a body if the motion is not performed correctly. This is especially true in individuals who are physically challenged or debilitated, such as and without limitation, elderly individuals or even geriatric individuals (e.g., muscle degradation, joint degradation, bone degradation, and/or the like are common influences of the aging process).

There is therefore a need for an apparatus which allows an individual to stretch, strengthen, and tone muscles in a convenient and safe manner. There is also a need for an apparatus which allows an individual of substantially any age to stretch, strengthen, and tone muscles in a tensile mode and in a convenient and safe manner, and which overcomes some or all of the previously delineated drawbacks of prior exercise apparatuses.

SUMMARY OF THE INVENTION

A first non-limiting advantage of the present invention is that it provides an apparatus, which allows for the selective exercise of an individual in a manner, which overcomes the previously delineated drawbacks of prior exercise apparatuses.

A second non-limiting advantage of the present invention is that it provides an apparatus which allows for the selective exercise of an individual in a manner which overcomes the previously delineated drawbacks of prior exercise apparatuses and, more particularly, allows for the exercise of an individual in a tensile mode while concomitantly supporting the individual's body in an ergonomic and comfortable seated position.

A third non-limiting advantage of the present invention is that it provides an apparatus which may be selectively adjusted to comfortably receive, support, and permit an individual of substantially any size, weight, height, and or the like to selectively exercise his/her body in the tensile mode.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

Figure 1:
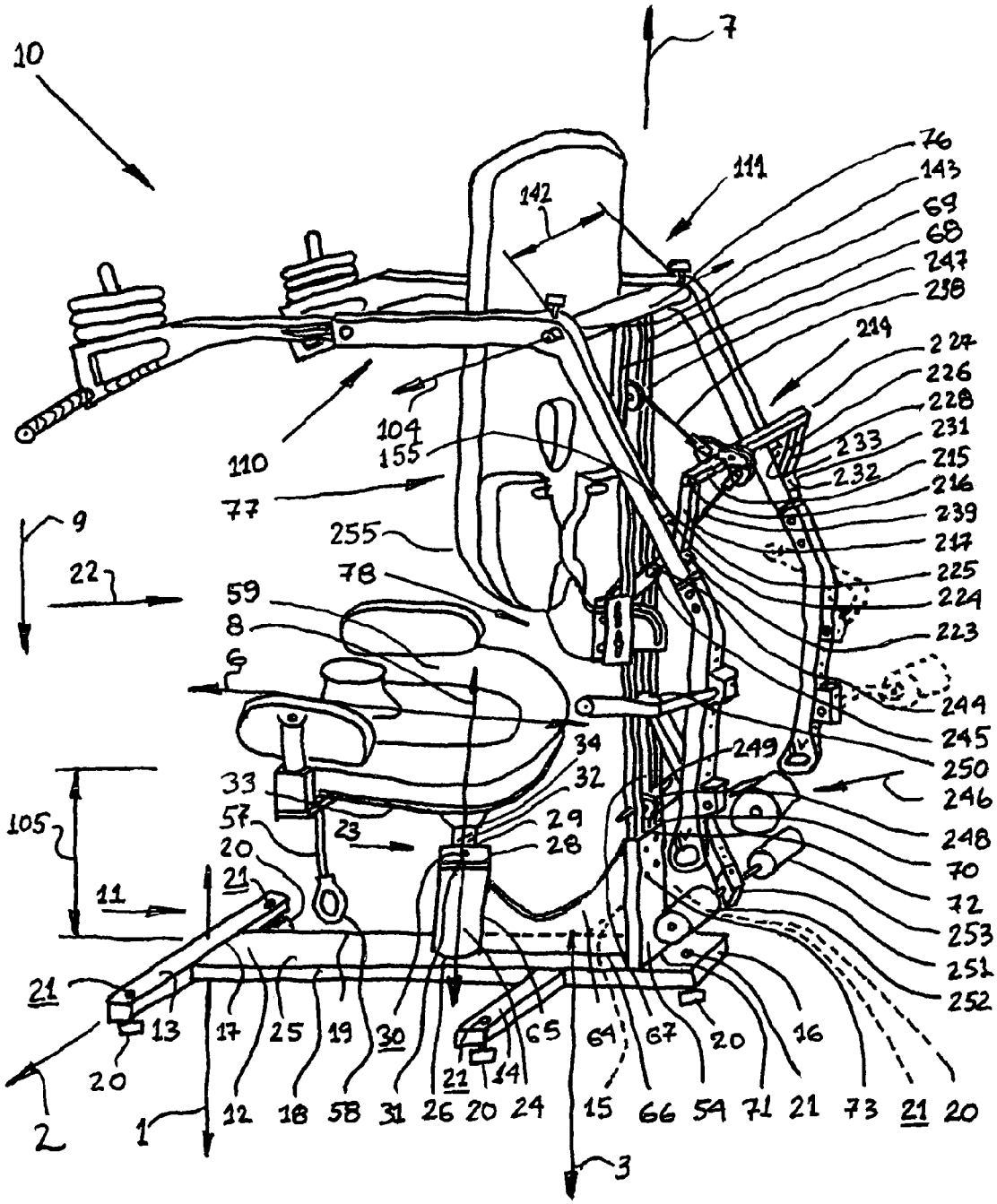
FIG. 1 is a perspective view of an exercise apparatus which is made in accordance with the teachings of the preferred embodiment of the invention, and which is shown with the leg separator pad remote from the back pad.

The present invention may be understood more readily by reference to the following detailed description of preferred embodiments of the invention.

Before the present methods and apparatuses are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

Referring now to FIGS. 1-5, there is shown an exercise apparatus 10 which is made in accordance with the teachings of the preferred embodiment of the invention. As shown, the exercise apparatus 10 includes a generally "I-shaped" base frame assembly 11 comprising a center rail 12, a second rail 13, and substantially identical third and fourth side rails 14, 15, each of which will be discussed further below.

Particularly, center rail 12 is generally planar and having a rectangular cross-section from a first end 16 to a second end 17. Further, Center rail 12 is orthogonally coupled to second rail 13 at end 17 at vertical axis 1 (i.e., center rail 12 orthogonally emanates from rail 13 at axis 1, and where axis 1 defines the midpoint of rail 13 along longitudinal axis 2). It should be appreciated that center rail 12 may be coupled to rail 13 by a welded connection, by screws or bolts, or substantially any other type of connection strategy or technique.

Furthermore, base frame assembly 11 has a plurality of substantially similar and generally planar side frame rails 14, and which are respectively and orthogonally coupled to center rail 12 at vertical axis 3 (i.e., side frame rail 14 orthogonally emanates and terminates from surface 18 of center rail 12 at axis 3 while side rail 15 orthogonally emanates and terminates into surface 19 of center rail 12 at axis 3), and this coupling may be made by a welded connection, by screws or bolts, or substantially any other type of connection strategy or technique. Side frame rails 14, 15 being coupled to center rail 12 prevents base frame assembly 11 from becoming unsteady during use of the exercise apparatus 10.

Further, base frame assembly 11 has a plurality of substantially similar apertures, such as aperture 21, which traverses through rails 12, 13, 14, and 15, and which threadably receive a plurality of substantially similar "non-marking" anti-slip and selectively adjustable screws, such as screw 20, within each aperture 21. Selectively adjustable screws, such as screw 21, is effective to provide stability to base frame assembly 11 of exercise apparatus 10 so that by adjusting screw 21, exercise apparatus 10 securely contacts with the floor surface (e.g., substantially any desired surface, such as concrete, carpet, tile, and/or like) at substantially similar screws, such as screw 21, and thus prevents exercise apparatus 10 from becoming unsteady during the repetitive motion of a user during use of the apparatus 10.

The exercise apparatus 10 further includes a seat assembly 22 coupled to base frame assembly 11 through a swivel bearing assembly 23. Particularly, swivel bearing assembly 23 comprises a generally cylindrical and tubular column 24 housing a longitudinal internal cavity 636 (shown in FIG. 4). Further, column 24 is orthogonally coupled to surface 25 of center rail 12 at a first end 26 along vertical axis 8 (i.e., column 24 orthogonally emanates from center rail 12 and forms a 90 degree angle with surface 25), and with column 24 terminating into a plurality of substantially similar bearing retainers 644, 645 (FIG. 4).

Figure 4:
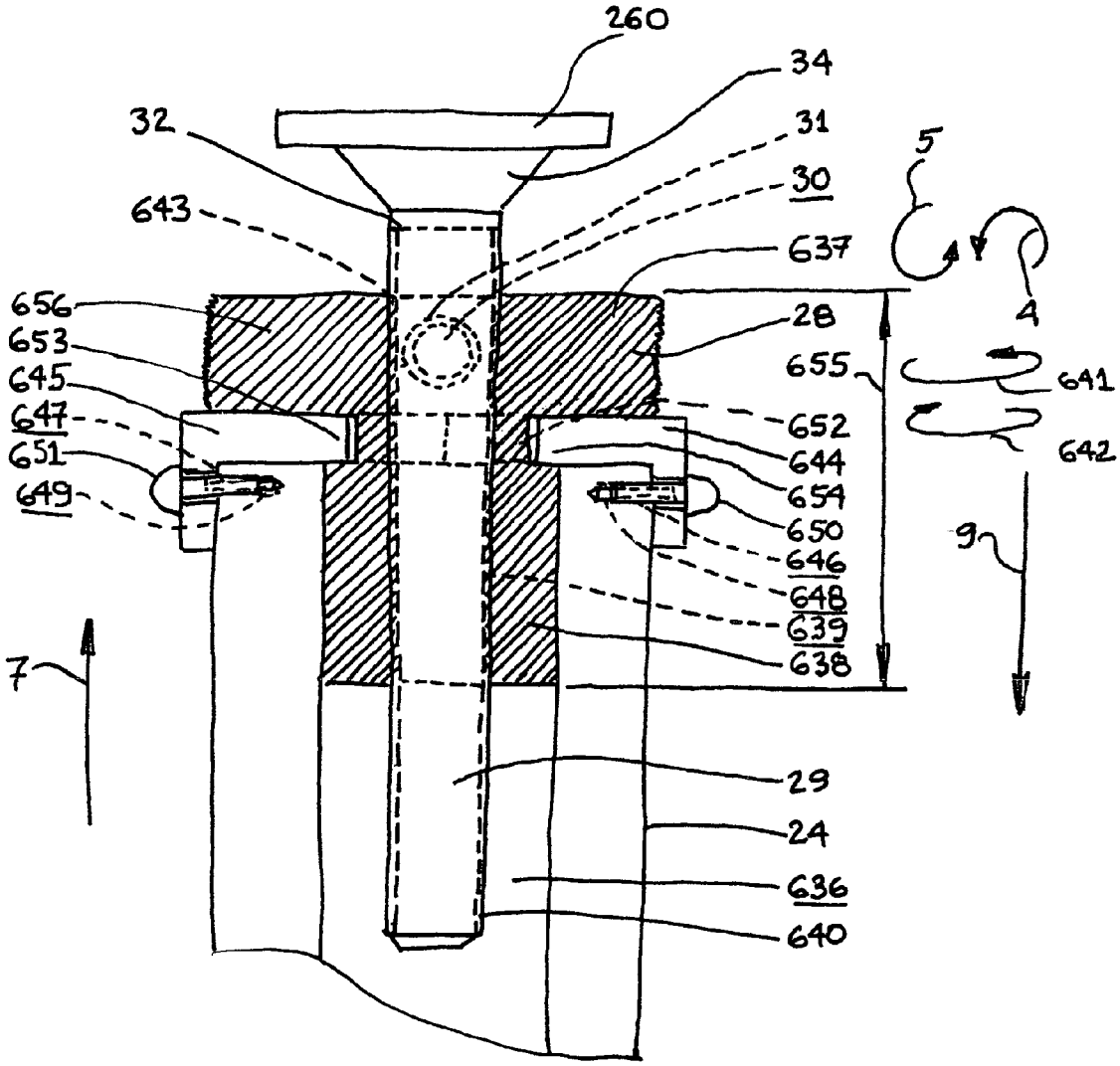
FIG. 4 is a partial cross-sectional view of a bearing assembly of the preferred embodiment of the invention which is shown in FIGS. 1-2.
Figure 5:
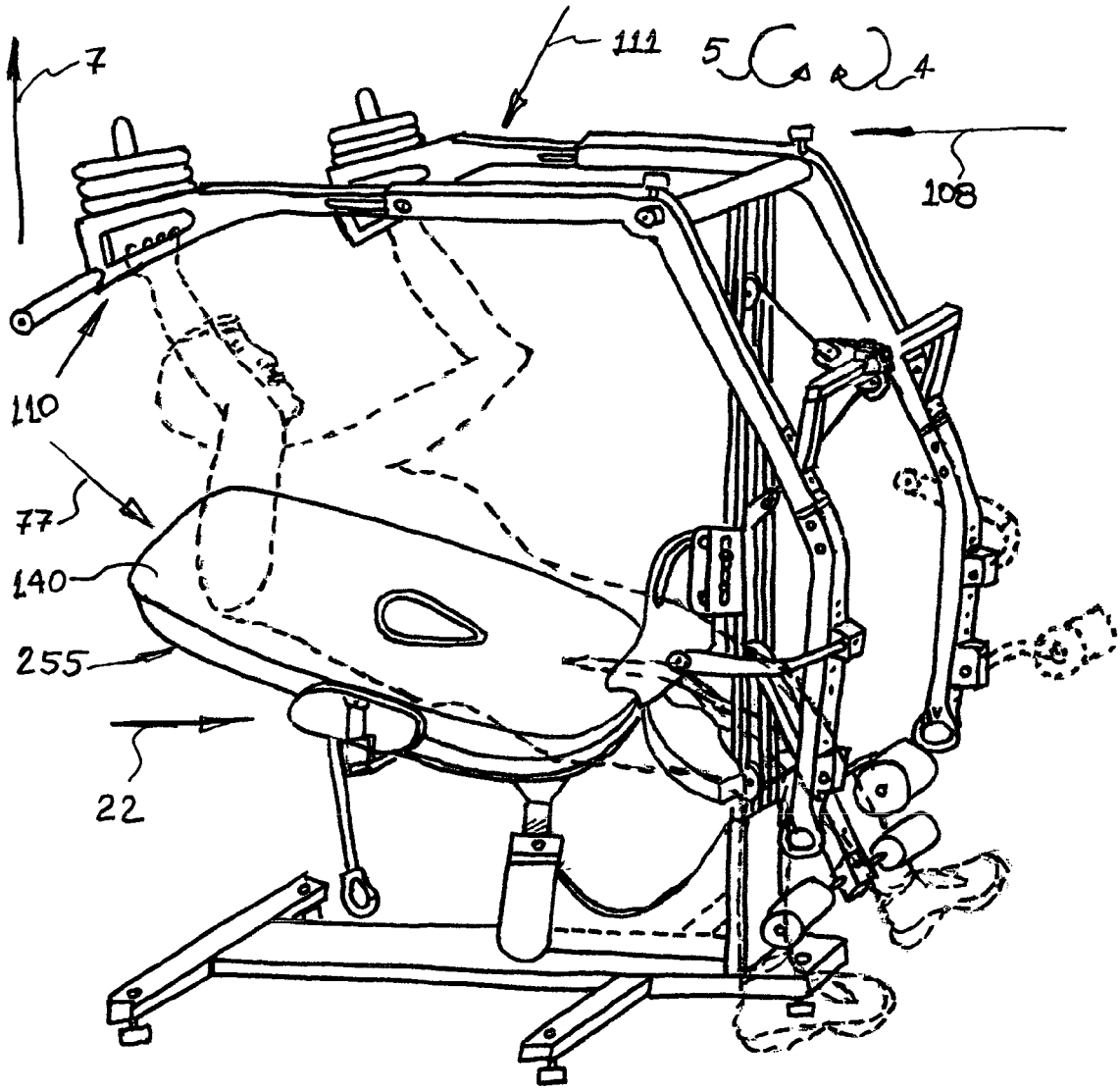
FIG. 5 is a perspective view of the exercise apparatus which is shown in FIGS. 1-4, but which is shown with the exercise apparatus being utilized as a bench press and body stretch exercise apparatus.

Particularly, and shown in FIG. 4, substantially similar bearing retainers 644, 645 are generally semi-cylindrically shaped, and respective bearing retainers 644, 645 have respective apertures 646, 647 that traverse through bearing retainers 644, 645 (i.e., bearing retainer 644 having aperture 646 and bearing retainer 645 having aperture 647), with apertures 646, 647 being aligned with respective apertures 648, 649, which traverse column 24 (i.e., aperture 648 is aligned with aperture 646, and aperture 649 is aligned with aperture 647). Furthermore, respective apertures 646, 647 cooperate with respective apertures 648, 649 to receive respective threaded screws 650, 651 (i.e., apertures 647, 649 receive threaded screw 651, and apertures 646, 648 receive threaded screw 650), and threaded screws 650, 651 being effective to fix-ably couple respective bearing retainers 644, 645 to column 24.

Further, bearing retainers 644, 645 are slidably coupled to a generally cylindrical bushing 28 (i.e., bushing 28 is a commercially available truss bearing which encloses a radial bearing between truss bearing and rod 29). Specifically, bushing 28 has a first portion 637 which is generally cylindrical and which terminates into a generally cylindrical and elongated second portion 638, with portion 638 residing within cavity 636 of column 24. Also, bushing 28 encloses a cavity 639 which is longitudinally coextensive with height 655 of bushing 28, and bushing 28 having a plurality of circumferential threads 643 on inside surface of bushing 28 with circumferential threads being linearly coextensive with height 655 of bushing 28. Further, bushing 28 has a circumferential channel 652 formed on the outer surface of portion 638, with channel 652 receiving end 653 of bearing retainer 645 and channel 652 also receiving end 654 of bearing retainer 644. Ends 653, 654 cooperate to rotatably couple bushing 28 to column 24, thereby effective to prevent bushing 28 from slidably decoupling from rod 29 in direction 7, and also effective to cause bushing 28 to be rotatably coupled to column 24 and rod 29. Also, bushing 28 includes, in one-non limiting embodiment, an aperture 30 which traverses portion 637 (i.e. aperture 30 connects outer surface 656 to inner cavity 643), and aperture 30 having a plurality of circumferential threads (not shown) which are provided to receive complementary circumferential threads (not shown) on adjustment screw 31, thereby effective to couple screw 31 to aperture 30 and further couple screw 31 to bushing 28.

Figure 3:
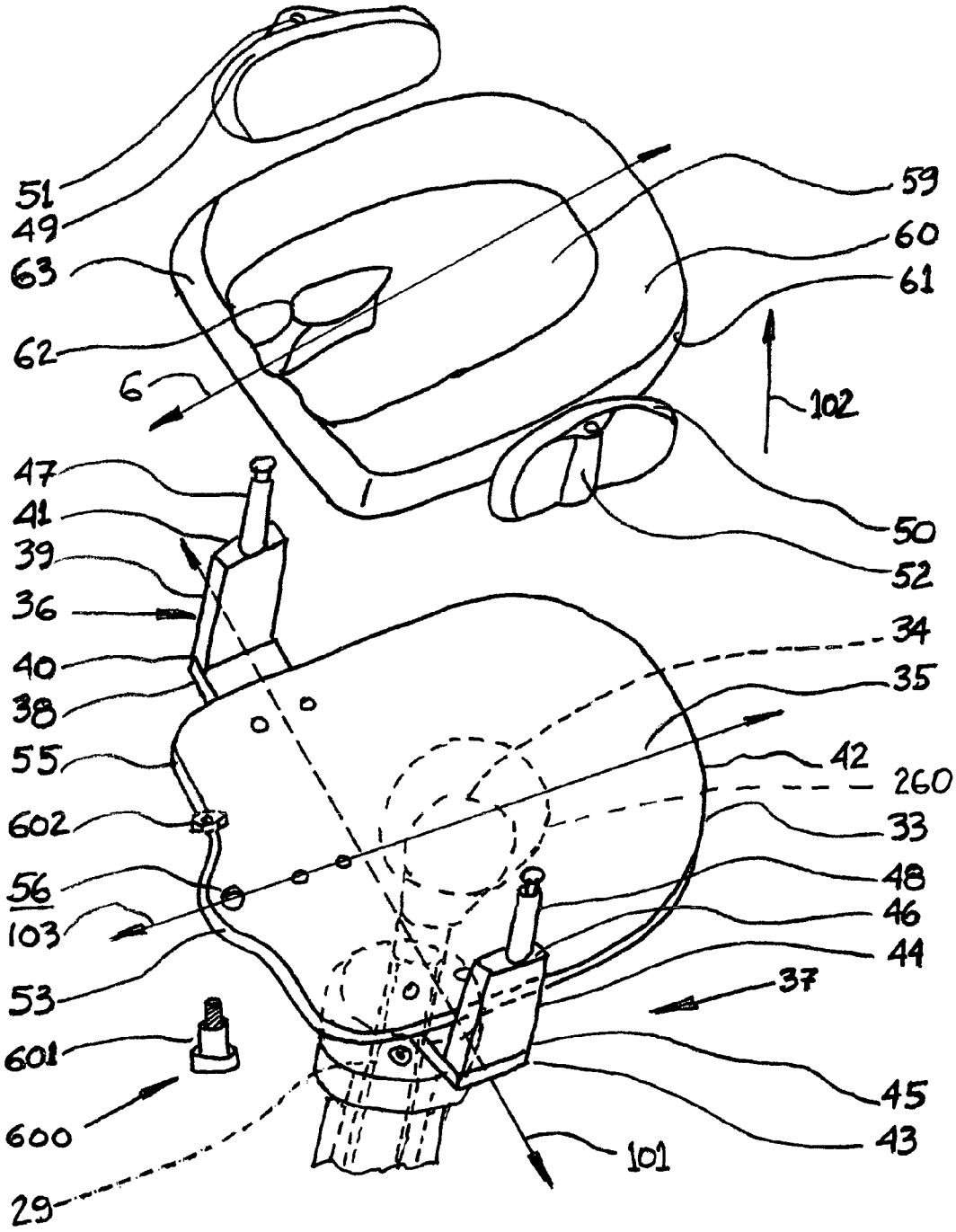
FIG. 3 is a partial exploded view of a seat assembly of the preferred embodiment which was shown in FIGS. 1-2.

Yet further and as shown in FIGS. 3 and 4, swivel bearing assembly 23 comprises an adjustment rod 29 coupled to column 24. Particularly, and as shown in FIG. 4, adjustment rod 29 is generally cylindrical and having a first end 640 residing within internal cavity 636 of column 24 and a second generally "conical-shaped" and opposed end 34 terminating into a generally "circular-shaped" planar member 260, although nothing in this embodiment limits the member 260 to the shape disclosed. Furthermore, adjustment rod 29 has a plurality of circumferential threads, such as thread 32, on the outer surface of threaded rod 29, and circumferential threads, such as thread 32, and which is longitudinally coextensive with rod 29. Furthermore, member 260 is fixably coupled to surface 42 of seat frame 33, and this coupling may be made by a welded connection, by screws, by bolts, or by substantially any type of connection strategy or technique. It should be appreciated that adjustment rod 29 is received within respective cavities 639, 636 of respective bushing 28 and column 24 (i.e., rod 29 is received in cavity 639 of bushing 28 and also received in cavity 636 of rod 24).

In operation, adjustment rod 29 may be lowered in direction 9 or raised in direction 7 by rotating adjustment screw 31 counter-clockwise in direction 5, thereby effective to retract adjustment screw 31 from the aperture 30 and out of contact with bushing 28. Bushing 28 is now rotated along arcuate direction 641 or arcuate direction 642, and which causes threads 643 of bushing 28 to engage threads 32 of rod 29 and further cause rod 29 to be respectively raised in direction 7 or lowered in direction 9 to adjust the height 105 (FIG. 1) of seat assembly 22. The adjustment screw 31 may now be rotated in a clockwise direction along arcuate direction 4, thereby effective to cause screw 31 to travel into aperture 30 and cause screw 31 to engage adjustment rod 29, thereby locking adjustment rod 29 and preventing rod 29 from traveling either downward in direction 9 or upward in direction 7. It should be appreciated that threads 643 of bushing 29 engages threads 32 of adjustment rod 29, thereby effective to support the weight of seat assembly 22. It should also be appreciated that column 24 of swivel bearing assembly 23 is sized to conformingly receive adjustment rod 29 (i.e., the adjustment rod 29 is movably disposed inside of the column 24), effective to allow swivel bearing assembly 23 to be selectively coupled at substantially any desired length by use of the adjustment screw 31. It should also be appreciated that swivel bearing assembly 23 is not limited to the features as described and may utilize any conventional mechanism to adjust the height 105 of seat assembly 22, such as and without limitation, a gas or hydraulic fluid-filled shaft.

Furthermore and as best seen in FIG. 3, seat assembly 22 comprises a rigid and generally flat seat frame 33 orthogonally coupled to member 260. Particularly, seat frame 33 is generally semi-circular in shape and has a first surface 42 orthogonally and fix-ably coupled to a generally planar member 260, and this coupling may be made by a welded connection, by screws, by bolts, or by any other type of connection strategy or technique. Yet further, seat frame 33 has a first generally "L-shaped" member 36 coupled to seat frame 33 at axis 101, and a substantially similar and directly opposed second generally "L-shaped" member 37 coupled at axis 101. That is, "L-shaped" member 36 has a first generally planar portion 38 which is coupled to surface 42, and a second generally planar portion 39 which is orthogonally coupled to portion 38 at first end 40 (i.e., portion 39 forming a 90 degree angle with surface 35), and a second and opposed end 41 which terminates into a generally cylindrical and orthogonally coupled connection rod 47 (i.e., connection rod 47 emanates from end 41 in direction 102). Similarly, "L-shaped" member 37 has a first portion 43 has a first generally planar portion 43 which is coupled to surface 42, and a second generally planar portion 44 which is orthogonally coupled to portion 43 at first end 45 (i.e., portion 44 forming a 90 degree angle with surface 35), and a second and opposed end 46 which terminates into a generally cylindrical and orthogonally coupled connection rod 48 (i.e., connection rod 48 emanates from end 46 in direction 102). Also, connection rods 47, 48 are provided to receive respective leg pressure pads 49, 50. Particularly, substantially similar pads 49, 50 are generally rectangular in shape and have a plurality of "U-shaped" portions 51, 52 coupled to pads 49, 50 and which receive respective connection rods 47, 48 to couple pads 49, 50 to seat frame 33. Pads 49, 50 are effective to abut the thighs of a user's leg when seated on buttocks pad 59, and thereby cushion a users thighs when utilizing exercise apparatus 10.

Yet further, seat frame 33 has a shoulder-bolt mounting portion 53 coupled to seat frame 33. Particularly, shoulder-bolt mounting portion 53 is generally "semi-circular" and portion 53 protrudes from seat frame 33 along axis 103 at anterior end 55 (axis 103 is the horizontal axis of symmetry of seat frame 33). Further, portion 53 has a through aperture 56 (i.e., aperture 56 passes through seat frame 33 and couples surface 42 with surface 35), and aperture 56 is provided to be receive, in one non-limiting embodiment, a shoulder bolt and nut assembly 600 coupled to a cable, such as in one non-limiting embodiment, cable 57.

Furthermore, seat assembly 22 comprises a buttocks pad 59 coupled to seat frame 33. That is, buttocks pad 59, in one non-limiting embodiment, is generally semi-circular in shape, although other shapes may be used, and bottom surface 61 of pad 59 is coupled to top surface 35 of seat frame 33 to provide a pad 59 which is designed to comfortably receive and support the buttocks of a user, and in this coupled position, the shoulder-bolt mounting portion 53 (as best seen in FIG. 3) is exposed to allow the shoulder-bolt 600 to be easily and efficiently coupled to aperture 56 of portion 53. It should be appreciated that the buttocks pad 59 may be coupled to seat frame 33 by glue, by screws, or substantially any other connection strategy or technique. Furthermore, buttocks pad 59 has a leg separator pad 62 formed at anterior end 63 of pad 59 along horizontal axis of symmetry 6 of buttocks pad 59 (i.e., axis 6 is the center of buttocks pad 59), with axis 6 being aligned with axis 103 of seat frame 33. It should be appreciated that leg separator pad 62 is provided to separate a users left and right legs when a user is seated on buttocks pad 59 (i.e., pad 62 prevents a users left and right legs from making contact with each other at a users knees) thereby providing a comfortable and efficient seated position while at the same time forcing a users legs to make contact with cushion pads 49, 50.

Figure 2:
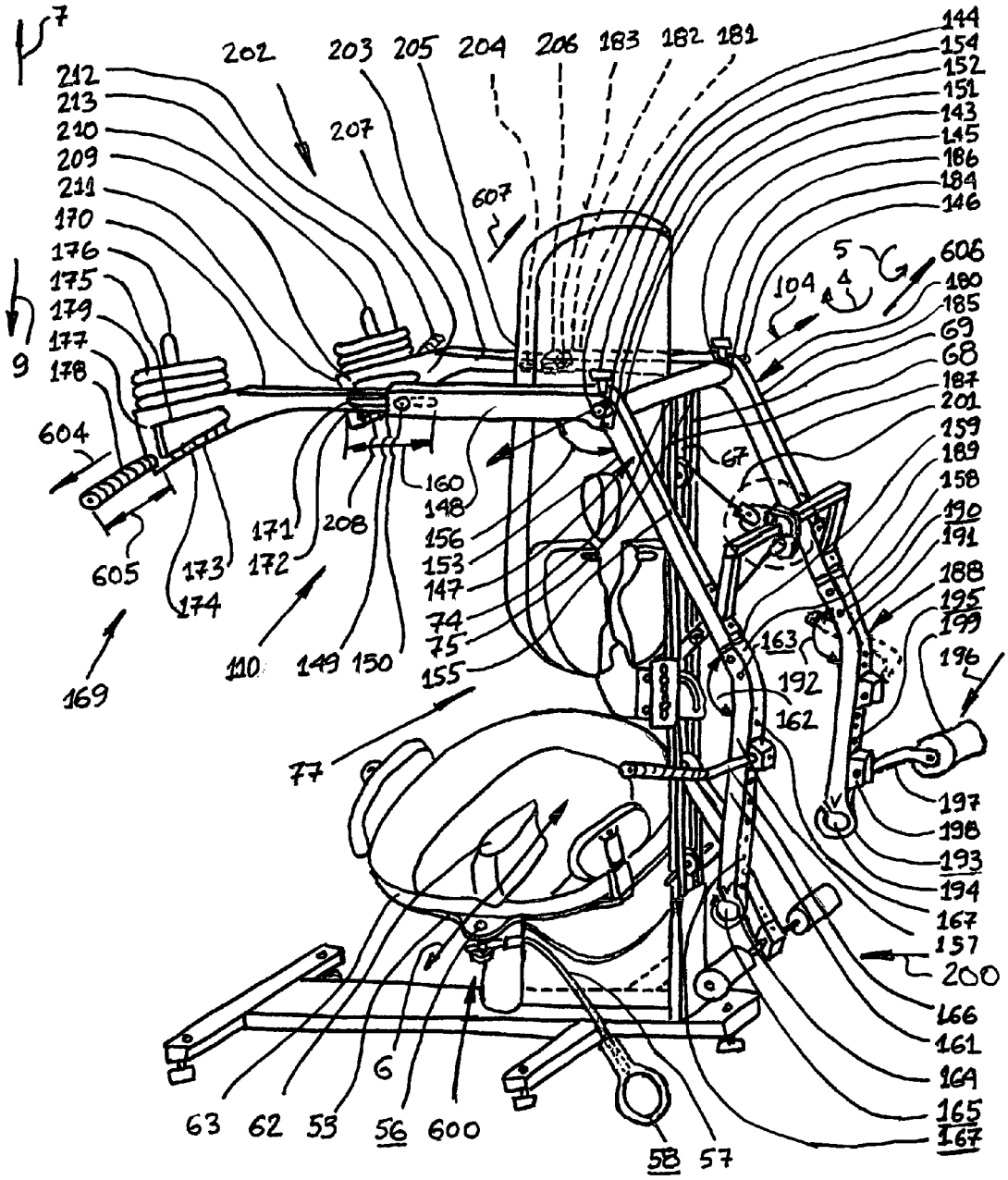
FIG. 2 is a perspective view of the exercise apparatus which is shown in FIG. 1, but which is shown with the leg separator pad rotated by 90 degrees.

As shown in FIGS. 1-2, seat assembly 22 further includes a cable 57 coupled to frame 33. That is, cable 57 includes a first end loop (not shown) coupled to seat frame 33 by the use of a shoulder-bolt assembly 600 (FIG. 3). That is, shoulder-bolt assembly 600 comprises a shoulder-bolt 601 which passes through and is received in aperture 56 of seat frame 33, and bolt 601 also passing through first end loop (not shown) cable 57. Shoulder-bolt 601 is coupled to seat frame 33 by a threaded nut 602 which receives threaded end of bolt 601. Cable 57 also comprises a second opposed end loop 58 which is coupled to actuator arm assembly 80 (as shown in FIG. 1), and this coupling may be made by hooks, screws, or substantially any connection technique or strategy.

Yet further, exercise apparatus 10 comprises a generally "trapezoidal" base support 64 coupled to base frame assembly 11. That is, base support 64 is coupled to column 24 along a first vertical edge 51, base support 64 is coupled to surface 25 of center rail 12 along a second horizontal edge 52 coupled to surface 25 of center rail 12, and base support 64 is coupled to vertical beam 54 along a third vertical edge 67 (which will be described later), and this coupling may be made by a welded connection, by crews, or substantially any other connection strategy or technique. Base support 64 reinforces the structural integrity of exercise apparatus 10 by minimizing the vibrations in column 24 and in vertical beam 54.

As shown in FIG. 1, exercise apparatus 10 also comprises rigid vertical beams 54, 68, 69 coupled to base frame assembly 11. Particularly, the vertical beam 54 is generally tubular in shape and having a rectangular cross-section and comprising a cavity 70, which is longitudinally coextensive with beam 54. Further, beam 54 comprises a first end 71 which is coupled to surface 25 of center beam 12, and a second open end 72 which receives substantially identical vertical beams 68, 69 within cavity 70, and beams 68, 69 are fixedly coupled to beam 54 by a plurality of substantially identical screws, such as and without limitation, screw 73 which is disposed through a plurality of apertures (not shown) in vertical beam 54 and which is effective to fixedly secure vertical beams 68, 69 to beam 54. Yet further, substantially identical vertical beams 68, 69 are generally coplanar and tubular in shape, and have respective first ends (not shown) contained in and residing within cavity 70 of vertical beam 54 and coupled to vertical beam 54 by a plurality of substantially identical screws, such as screw 73. Also, respective beams 68, 69 extend (i.e., emanate) from cavity 70 along vertical direction 7 and terminate into and is coupled to frame member 76. That is, respective beams 68, 69, are generally parallel and are respectively and fixedly coupled to horizontal frame member 76 at respective ends 74, 75 (i.e., beam 68 is separated from beam 69 by a groove 67 which is coextensive with length of beams 68, 69). Moreover, horizontal frame member 76 is disposed along horizontal axis 8 and axis 8 forms a pivot point for clockwise rotation 4 or counterclockwise rotation 5 of actuator arm assemblies 110, 111, and which will be discussed below.

Figure 6:
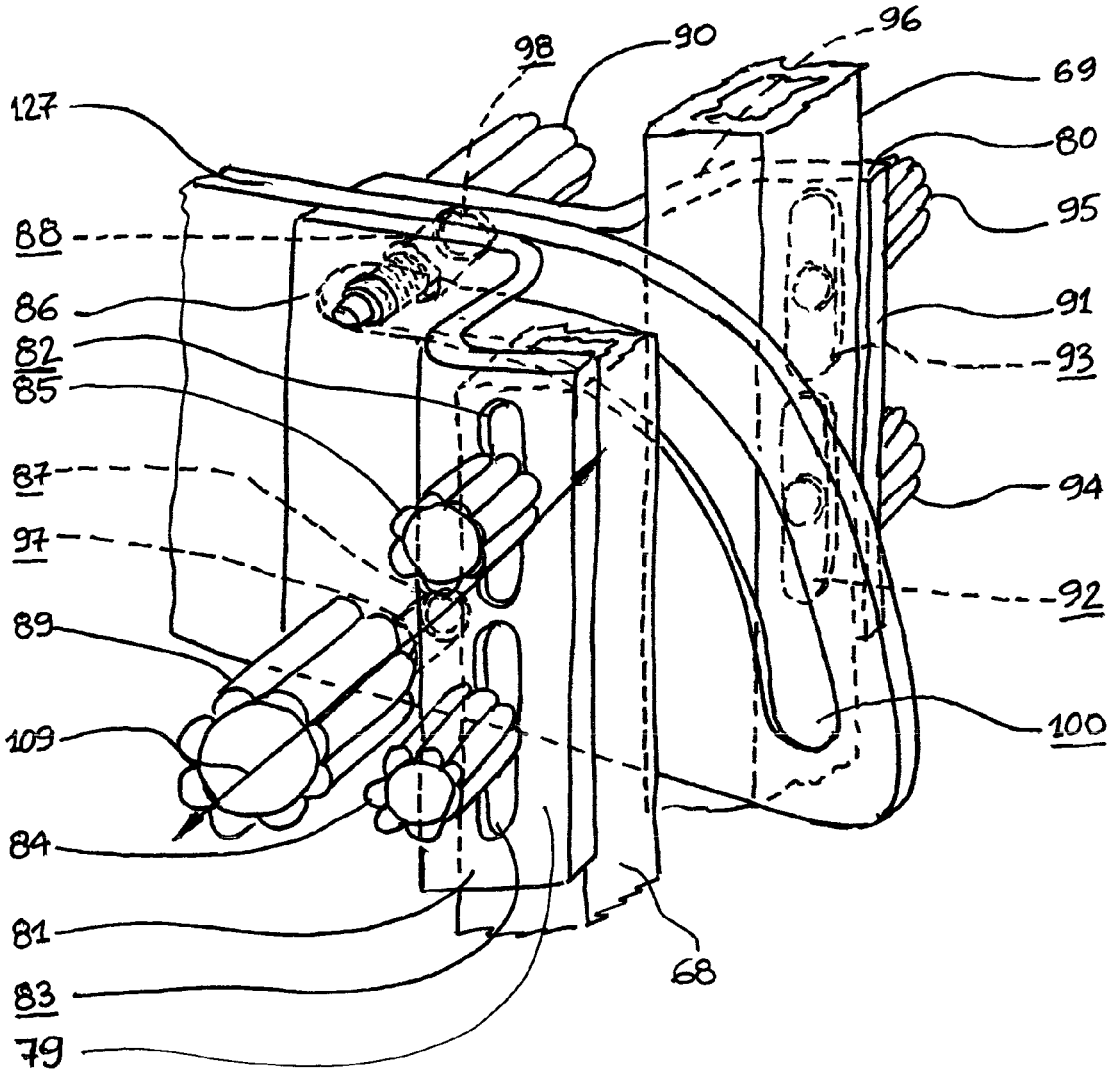
FIG. 6 is a partial perspective view of a release mechanism of the back pad assembly which is shown in FIGS. 1-2, and 5.
Figure 7:
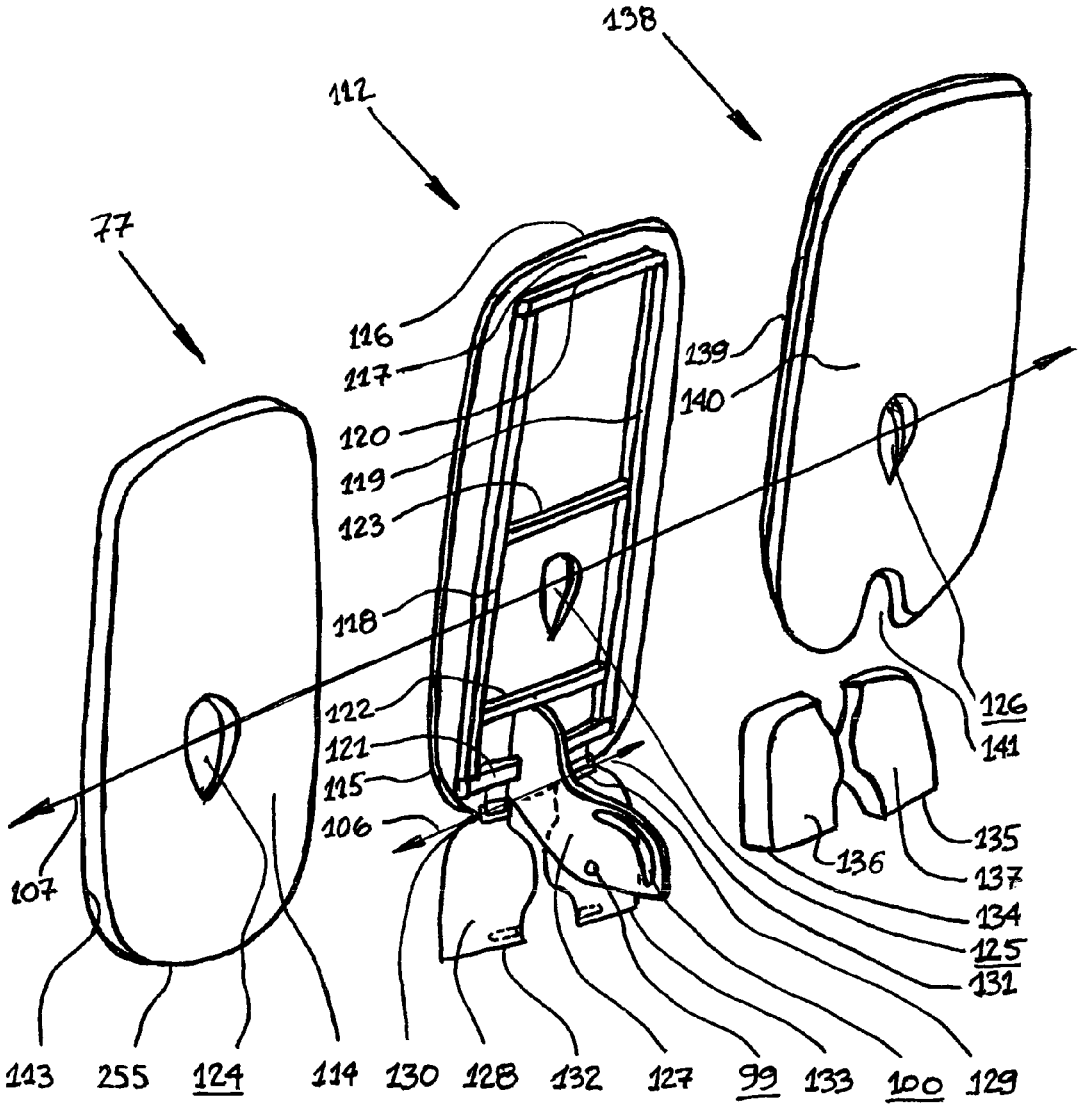
FIG. 7 is a exploded perspective view of the back pad assembly which is shown in FIGS. 1-2 and 5

Exercise apparatus of the preferred embodiment, and as best seen in FIGS. 1, 6, and 7, further comprises a selectively movable back pad assembly 77 coupled to vertical beams 68, 69 through a pivot bracket assembly 78. Particularly, pivot bracket assembly 78 comprises a plurality of generally "S-shaped" rigid members 79, 80 coupled to vertical beams 68, 69 respectively. Member 79 includes a first planar portion 81 comprising a plurality of elongated slots 82, 83 which are formed in portion 81 and which are provided to receive respective screws 84, 85. Respective screws 84, 85 couple member 79 to vertical beam 68 through a plurality of substantially similar apertures (not shown) which are provided on vertical beam 68 and which are aligned with respective slots 82, 83 (i.e., screws 84, 85 are received within apertures on vertical beam 68 and within slots 82, 83). Also, portion 81 terminates into a generally "L-shaped" portion 86, and portion 86 being orthogonal with portion 81 (i.e., portion 86 forms a 90-degree angle with portion 81). Portion 86 has a plurality of substantially similar apertures 87, 88 which are provided to receive substantially similar screws 89, 90 (i.e., screw 89 is received in aperture 87 and screw 90 is received in aperture 88). Similarly, member 80 includes a first planar portion 91 comprising a plurality of elongated slots 92, 93 which traverse through portion 91 and which are provided to receive respective screws 94, 95. Respective screws 94, 95 couple member 91 to vertical beam 69 through a plurality of substantially similar apertures (not shown) which are provided on vertical beam 69 and which are directly opposed and aligned with respective slots 92, 93 (i.e., screws 94, 95 are received within apertures on vertical beams 69 and within slots 92, 93). Also, portion 91 terminates into a generally "L-shaped" portion 96, with portion 96 being orthogonal with portion 91 (i.e., portion 96 forms a 90-degree angle with portion 91). Portion 96 further has a plurality of substantially similar apertures 97, 98 which are provided to receive substantially similar screws 89, 90 (i.e., screw 89 is received in aperture 97 and screw 90 is received in aperture 98). Yet further, screws 89, 90 are provided to be received within respective hole 99 and arcuate slot 100 (FIG. 7), thereby effective to couple pivot bracket assembly 78 to back pad assembly 77 and which will be discussed further below. Screws 84, 85, 94, 95 are selectively movable to adjust the position of the back pad assembly 77 relative to the position of seat assembly 22, by selectively moving back pad assembly 77 along vertical directions 7 or vertical direction 9 so that screws 84, 85, 94, 95 are contained within the elongated apertures 82, 83, 92, 93.

Yet further and as shown in FIG. 7, the back pad assembly 77 includes a generally rectangular and flexible back support pad 255 fixedly coupled to a rigid back frame assembly 112. Particularly, back support pad 255 has a front surface 113 which abuts a users back and a second and opposed back surface 114 which is coupled to first surface 116 of rigid board member 115, and this coupling may be made by glue, by screws, or substantially any type of connection strategy or technique. Further, back support pad 255 has an aperture 124 which traverses through back support pad 255. Also, opposed surface 117 of board member 115 is coupled to a plurality of planar member 118, 119, 120, 121, 122 and 123. Board member 115 also has an aperture 125 which traverses through member 115 and which is aligned with aperture 124 of back pad 255. Further, member 118 is coupled to member 119 by members 120, 121, 122, and 123 and members 120, 121, 122, and 123 being orthogonal to member 118 and orthogonal to member 119, and this coupling may be made by a welded connection, by screws, or substantially any other type of connection strategy or technique. Members 118, 119, 120, 121, 122, and 123 provide structural integrity to back pad assembly 77 by supporting board member 115 and further preventing member 115 from bowing or flexing during use of the exercise apparatus 10.

Back frame assembly 112 further comprises a generally "C-shaped" member 127 orthogonally coupled to member 121 (i.e., member 127 forms a right angle with surface 117 of board member 115). "C-shaped" member 127 has a first hole 99 which traverses through member 127 and which is aligned with aperture 87 of portion 81 (FIG. 6) and which is further aligned with aperture 97 of portion 91 (FIG. 6) and which is provided to receive screw 89 which traverses aligned apertures 87, 99, 97, thereby effective to couple member 127 to members 81, 91, and further effective to couple back pad assembly 77 to vertical beams 68, 69. Also, member 127 has a second elongated and arcuate slot 100 which traverses through member 127 and which receives screw member 90 (FIG. 6). Further, member 90 traverses apertures 86, 98, 100. Yet further, back frame assembly 112 comprises a plurality of rigid and planar leg extender members 128, 129 respectively coupled to member 121 by a plurality of hinge members 130, 131 respectively, and where hinge members 130, 131 are aligned along axis 106. Also, members 128, 129 are coupled to a plurality of flexible pads 134, 135 respectively by coupling surfaces 132, 133 to respective surfaces 136, 137. It should be appreciated that hinge members 130, 131 causes members 127, 129 to pivot along axis 106 when a force, such as the force applied by a hand of a user, is applied on member 128, 129, thereby effective to cause respective pads 134, 135 to be extended from a stored position (FIG. 1) to a fully extended position (FIG. 9) and which will be discussed below.

Yet further and as shown in FIG. 7, back pad assembly 77 comprises a bench press assembly 138 coupled to back frame assembly 112. Particularly, bench press assembly 138 has a generally rectangular and rigid bench board member 139 coupled to a generally rectangular and flexible pad 140. Also, bench press assembly 138 has a groove 141 which protrudes in member 139 and also protrudes in pad 140 (i.e., member 140 and pad 141 have the same circumferential profile). Bench press assembly 138 has a through aperture 126 which traverses through bench press assembly 138 (i.e., aperture 126 traverses through member 140 and traverses through pad 141) and aperture 126 being formed along axis 107, which is formed along the same axis 107 as aperture 125 and which is along the same axis 107 as aperture 124, thereby effective to cause aperture 124 to align with aperture 125 and align with aperture 126. It should be appreciated that apertures 124, 125, 126 are formed to be aligned with and receive leg separator pad 62 within apertures 124, 125, 126 when back pad assembly 77 is rotated counterclockwise along arcuate axis 5 (FIG. 5) by applying a force on back pad assembly 77 along direction 108, such as the force applied by the hands of a user, thereby causing back pad assembly 77 to rotate in arcuate direction 5 along pivot axis 109 which is the pivot point of screw member 89 (FIGS. 4, 6). It should be appreciated that, in this manner, a user of the apparatus 10 may rest the back pad assembly 77 on the buttocks pad 59 (FIG. 5), and rest a users back on pad 140 of the back pad assembly 77, while positioning a users shins behind leg pads 252, 253 (which will be described below) while concomitantly grasping actuator arm assemblies 110, 111, and pushing actuator arm assemblies 110, 111 in direction 7 and thereby effective to utilize the exercise apparatus 10 to perform a bench press exercise by overcoming the weight of the actuator arm assemblies 110, 111.

Furthermore, and as shown in FIGS. 1-2, exercise apparatus 10 of the preferred embodiment comprises a plurality of actuator arm assemblies 110, 111 pivotally coupled to horizontal frame member 76. It should be appreciated that the features and functionality of actuator arm assembly 110 is substantially the same as the features and functionality of actuator arm assembly 111. Particularly, horizontal frame member 76 is generally cylindrical and tubular and is orthogonally and fixedly coupled to vertical beams 68, 69 along horizontal axis 104. Further, horizontal frame member 76 encloses a cavity which is linearly coextensive with length 142 of member 76. Also, member 76 has a first end 143 which is coupled to and receives an elongated and generally cylindrical shaft 144, and a second end 145 which receives and is coupled to a substantially similar elongated and cylindrical shaft 146. Substantially similar shafts 144, 146 are coupled to respective ends 143, 145 by respective rotate-able bearings (not shown) which are circumferentially coupled to respective shafts 144, 146 at respective ends which reside within ends 143, 145 of horizontal frame member 76. Respective shafts 144, 1446 have respective second and opposed ends which are respectively coupled to actuator arm assemblies 110, 111. Rotate-able bearings cause respective shafts 144, 146 to be rotated along arcuate axis 4 or arcuate axis 5 when a force is applied to actuator arm assemblies 110, 111 and which will be described below.

Further and as shown in FIG. 2, actuator arm assembly 110 has a first generally "L-shaped" member 147 which is generally hollow and which comprises a first planar portion 148 having a rectangular cross-section, and having an aperture (not shown) which traverse through portion 148 at first end 149 and which selectively receives a hand adjustable screw member 150, and portion 148 terminating into a circular collar portion 151 at opposite second end 152. Collar portion 151 is generally "circular" in shape includes an external aperture which is separated from internal cavity of collar portion 151 and which traverses through collar portion 151 along axis 104, and aperture having a width which is slightly greater than the width of shaft 144 which is slide-ably coupled to portion 151 and which is received within aperture and which emanates from aperture and extends beyond surface 153 of collar portion 151. Also, collar portion 151 includes a second aperture, such that a hand screw, such as and without limitation, hand screw 154 may be disposed through the aperture and which is effective to slide-ably couple actuator arm assembly 110 on elongated shaft 144, thereby preventing actuator arm assembly 110 from sliding out of contact from shaft 144. Further, member 147 comprises a second planar portion 155 having a rectangular cross-section, and which emanates from circular collar portion 151 and forming an angle 156 with portion 148.

FIG. 2 further shows actuator arm assembly 110 having a second hollow and generally "L-shaped" member 157 operatively coupled to planar portion 155, and member 157 comprising a first planar portion 158 which is slidably coupled to end 159 of planar portion 155. Planar portion 158 also comprises a plurality of substantially similar apertures, such as aperture 163, which traverses planar portion 158 and which are aligned with plurality of apertures on end 159 of portion 155 (not shown). Further, portion 158 terminates into second planar portion 161 having a rectangular cross-section, with portion 161 forming an angle 162 with portion 158. Also, portion 161 terminates into a generally "circular" hook portion 164 having a groove 165 which traverses through hook portion 164, and which is coupled to and receives loop 58 of cable 57. It should be appreciated that portion 158 has a diameter which is greater than the diameter of end 159, and which receives and is selectively coupled to end 159. That is portion 158 has a plurality of apertures which traverses through portion 158 and which is aligned with apertures which traverse through end 159 of portion 155, such that a pin, such as and without limitation, pin 163 may be disposed through portion 155 and portion 158 via the plurality of aligned apertures, thereby coupling portion 158 to portion 155, thereby effective to reinforce the coupling between planar portion 155 and portion 158, although this coupling may be made by a welded connection, by screws, or by substantially any other connection strategy or technique.

Yet further and as shown in FIG. 2, actuator arm assembly 110 of the preferred embodiment comprises of a selectively adjustable golf shaft handle portion 166, which is selectively coupled to portion 161 by a pin (not shown) which is disposed and received within apertures, such as aperture 167 which is provided in portion 161 and which selectively couples handle portion 166 to portion 161. In this manner, a user may selectively and conveniently utilize the exercise apparatus 10 to strengthen the associated muscles utilized during normal use of a golf club by grasping the shaft handle portion 166 and selectively rotating shaft portion clockwise 4 or counterclockwise 5, thereby concomitantly rotating actuator arm assembly 110 along the same clockwise arc 4 or counter clockwise arc 5, thereby strengthening the shoulder muscles associated with swinging a golf club.

Furthermore, actuator arm assembly 110 of the preferred embodiment comprises a handle assembly 169 slide-ably coupled to portion 148 of "L-shaped" member 147. Particularly, handle assembly 169 has a first solid portion 170 comprising a longitudinal channel 171 formed along a certain length 160 at end 172 on portion 170 (i.e., channel 171 is recessed in portion 170). Also, portion 170 is selectively coupled to and received within internal cavity of portion 148 at end 149. Portion 148 is coupled to portion 170 by a hand screw 150 with hand screw 150 having a threaded shaft (not shown), which is received within aperture (not shown) on end 149 and which engages channel 171, thereby being effective to fixedly and selectively couple generally handle assembly 169 to "L-shaped" member 147. Handle assembly 169 also includes a generally "triangular" handle member 173 which emanates and terminates from portion 170. That is, handle member 173 includes a first hand grip portion 174 for gripping by a user, a second portion 175 which is orthogonally coupled to a weight retention rod portion 176, and a third portion 177 which couples portion 175 to portion 174 (i.e., portion 177 is generally orthogonal to both portions 175 and 174). Also, handle member 173 has a generally tubular and cylindrical hand extension rod 178 which orthogonally emanates from handle member 173 in direction 604 which is generally parallel to axis 104, and with rod 178 having a cylindrical bushing (not shown) which resides longitudinally inside cavity of rod 178 along length 605, and which causes rod 178 to be selectively rotate-able clockwise along arcuate direction 4 or counter-clockwise in arcuate direction 5 when rod 178 is grasped by hands of a user. It should be appreciated that weight retention rod portion 176 is orthogonal to portion 175 and selectively receives weights, such as and without limitation, weight 179, which causes actuator arm assembly 110 to apply a downward force in direction 9, thereby effective to selectively increase the resistance and thus the difficulty when utilizing the exercise apparatus 10.

Furthermore, FIG. 2 shows exercise apparatus 10 having a substantially similar actuator arm assembly 111 coupled to horizontal frame member 76. Particularly, actuator arm assembly 111 has a first generally "L-shaped" member 180 which is generally hollow and which is substantially similar to generally "L-shaped" member 147, and member 180 having a first planar portion 181 having a rectangular cross-section, and having an aperture (not shown) which traverse through portion 181 at first end 182 and which selectively receives a hand adjustable screw member 183 which is substantially the same as screw member 150, and portion 181 terminating into a circular collar portion 184. Collar portion 184 is generally "circular" in shape includes an external aperture (not shown) which traverses collar portion 184 along axis 104, and external aperture having a width which is slightly greater than the width of shaft 146 which is slide-ably coupled to portion 184 and which is received within external aperture and which emanates from aperture and extends beyond surface 185 of member 180 in direction 606. Also, collar portion 184 includes a second aperture (not shown), such that a hand screw, such as and without limitation, hand screw 186 may be disposed through second aperture and which is effective to slide-ably couple actuator arm assembly 111 on elongated shaft 146, thereby selectively adjusting width 142 while concomitantly preventing actuator arm assembly 111 from sliding out of contact from shaft 146. Further, member 180 comprises a second planar portion 187 having a rectangular cross-section, and which emanates from circular collar portion 184 and forming substantially the same angle with portion 181 as angle 156 of "L-shaped" member 147.

FIG. 2 further shows actuator arm assembly 111 having a second hollow and generally "L-shaped" member 188, which is substantially similar to "L-shaped" member 157, and which is operatively coupled to planar portion 187, and member 188 comprising a first planar portion 189 which is slide-ably coupled to planar portion 187, and which comprises a plurality of substantially similar apertures, such as aperture 190, which traverses planar portion 189 and which receive a pin which traverses portion 189, thereby effective to fixedly and securely couple planar portion 187 to planar portion 189. Further, portion 189 terminates into second planar portion 191 having a rectangular cross-section, and portion 191 forming an angle 192 with portion 189. Also, portion 191 terminates into a circular hook portion 193 having a groove 194 which traverses through hook portion 193, and which is coupled to loop 58 of cable 57, thereby effective to couple seat assembly 22 to actuator arm assembly 11. It should be appreciated that portion 189 has a diameter which is greater than the diameter of portion 187, and which receives portion 187 within inside cavity (not shown) of portion 189 and which is selectively coupled to portion 187 by pin 190, although this coupling may be made by a welded connection, by screws, or by substantially any other connection strategy or technique. Yet further, actuator arm assembly 111 of the preferred embodiment comprises a plurality of apertures, such as aperture 195, which selectively receives and is coupled to golf shaft handle portion 166, thereby effective to utilize exercise apparatus 10 to strengthen the associated muscles utilized during normal use of a golf club by grasping the shaft handle portion 166 by a left-handed user and selectively rotating shaft portion clockwise 4 or counterclockwise 5, causing rotating actuator arm assembly 111 to concomitantly travel along the same clockwise arc 4 or counter clockwise arc 5.

Furthermore, actuator arm assembly 111 of the preferred embodiment comprises a substantially similar handle assembly 202 as handle assembly 202, and handle assembly 202 is slide-ably coupled to portion "L-shaped" member 180. Particularly, handle assembly 202 has a first solid portion 203 comprising a longitudinal channel 204 at end 205 on portion 203 (i.e., channel 204 is recessed in portion 203). Also, portion 203 is coupled to and is received within internal cavity of portion 181 at end 182. Portion 181 is coupled to portion 203 by a substantially similar hand screw 206 as hand screw 150, with hand screw 206 having a threaded shaft (not shown), which is received within aperture (not shown) on end 182 and which engages channel 204, thereby being effective to fixedly and selectively couple generally handle assembly 202 to "L-shaped" member 180. Handle assembly 202 also includes a generally "triangular" handle member 207 which emanates and terminates from portion 203. That is, handle member 207 includes a first hand grip portion 208 for gripping by a user, a second portion 209 which is orthogonally coupled to a weight retention rod portion 210, and a third portion 211 which couples portion 209 to portion 208 (i.e., portion 211 is generally orthogonal to both portions 209 and 208). Also, handle member 207 has a generally tubular and cylindrical hand extension rod 212 which is substantially similar to hand extension rod 178. Rod 212 orthogonally emanates from handle member 207 in direction 607 which is generally parallel to axis 104, and with rod 212 having a cylindrical bushing (not shown) which resides longitudinally inside cavity of rod 212, and which causes rod 212 to be selectively rotateable clockwise along arcuate direction 4 or counter-clockwise in arcuate direction 5 when rod 212 is grasped by hands of a user. It should be appreciated that weight retention rod portion 210 is orthogonal to portion 209 and selectively receives weights, such as and without limitation, weight 213, which causes actuator arm assembly 111 to apply a downward force in direction 9, thereby effective to selectively increase the resistance and thus the difficulty when utilizing the exercise apparatus 10.

Figure 8:
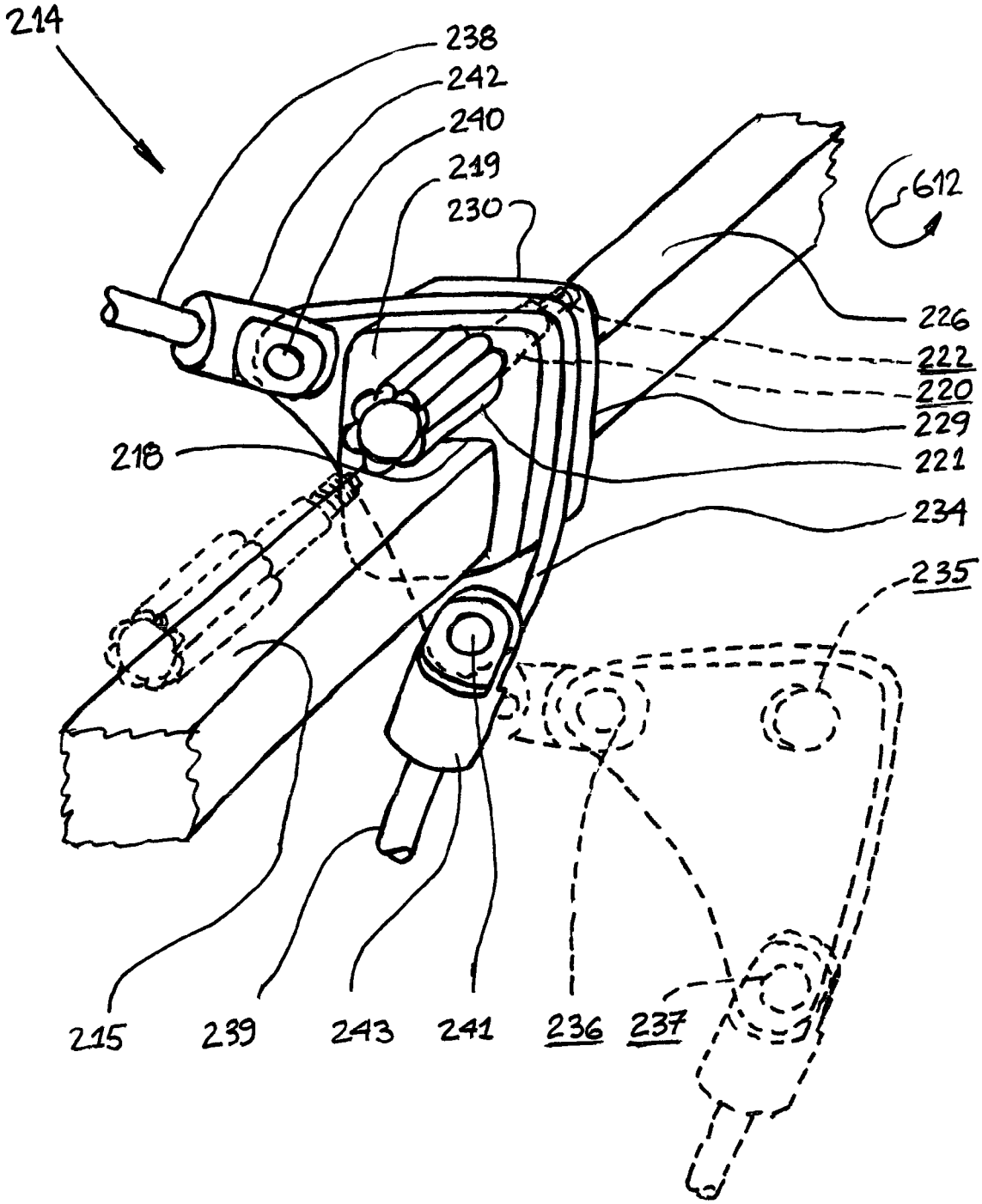
FIG. 8 is a partial perspective view of the locator bar assembly which is made in accordance with the teachings of the preferred embodiment of the invention and which is referenced as 201 in FIG. 2 of the preferred embodiment of the invention.

Furthermore, and as shown in FIGS. 1, 2, 5 and 8, exercise apparatus 10 of the preferred embodiment includes a locator bar assembly 214. Particularly and as shown in FIG. 8, locator bar assembly 214 comprises a first generally planar rail 215 having a rectangular cross-section and having a first end 216 which is orthogonally and fixedly coupled to portion 217 (i.e., portion 217 forms a 90 degree angle with rail 215), and an opposed second end 218 coupled to a generally rectangular locking plate 219 having a through aperture 220 which traverses plate 219 and which receives threaded end 222 of hand screw 221. Further, portion 217 is generally planar and is fixedly coupled to portion 155 of "L-shaped" member 147 by generally planar and flat member 225 which receives a plurality of pins 223, 224 which traverse apertures (not shown) on member 225 and also traverses apertures on portion 155 to fixedly couple portion 217 to "L-shaped" member 147. Yet further, locator bar assembly 214 comprises a second generally planar rail 226 having a rectangular cross-section and having a first end 227 which is orthogonally and fixedly coupled to portion 228 (i.e., portion 228 forms a 90 degree angle with rail 226), and an opposed second end 229 coupled to a generally rectangular locking plate 230 having a through aperture (not shown) which traverses plate 230, and which is aligned with through aperture 220, and which receives threaded end 222 of hand screw 221. Further, portion 228 is generally planar and is fixedly coupled to a generally planar and flat member 231 which receives a plurality of pins 232, 233 which traverse apertures (not shown) on member 231 and which also traverses apertures on portion 187 to fixedly couple portion 228 to "L-shaped" member 180.

Locator bar assembly 214 further comprises a generally triangular plate member 234 which is planar and which is coupled to planar rails 215, 226. Particularly, planar rails 215, 226 cooperate to receive plate 234, and plate 234 is selectively coupled to rails 215, 226 by through aperture 235 which traverses plate 234 and which receives threaded end 222 of hand screw 221. Also, plate member 234 has a plurality of substantially similar through apertures 236, 237 which traverse plate member 234 and which are coupled to a plurality of respective cables 238, 239 at respective hooks 242, 243 by a plurality of pins 240, 241 respectively (i.e., cable 238 is coupled to aperture 236 by pin 240 and cable 239 is coupled to aperture 237 by pin 241). Furthermore, and as best shown in FIG. 8, locator bar cable assembly 214 may be selectively unlatched by removing hand screw 221 by rotating hand screw 221 in arcuate direction 612 thereby effective to decouple rail 215 from rail 226, and causing actuator arm assembly 110 to be decoupled from actuator arm assembly 111.

Furthermore, and best shown in FIG. 1, cable 239 is coupled to vertical beams 68, 69 at second opposed end 244 by the use of a plurality of substantially similar and aligned through apertures (not shown) which traverse beams 68, 69 and which receive a conventional screw, such as screw 245, thereby coupling cable 239 to the locator bar assembly 214 and further to the vertical beams 68, 69. It should be appreciated that locator bar assembly 214 couples actuator arm assembly 110 to actuator arm assembly 111, and causes actuator arm assemblies 110, 111 to move together about pivot axis 104 (FIG. 2) when a user utilizes the exercise apparatus 10 by, in one non-limiting embodiment, moving the handle assemblies 169, 202 (FIG. 2). It should also be appreciated that cable 239 causes actuator arm assemblies 110, 111 to be secured to vertical beams 68, 69, thereby effective to prevent actuator arm assemblies 110, 111 from "falling" on a user (i.e., moving in a downward direction 9 when a user is positioned on buttocks pad) in the absence of a user applying a force in direction 7 (such as the force applied by a user's hands on handle assemblies 169, 202).

Also and as shown in FIG. 1, exercise apparatus 10 comprises a cable 238 coupled to leg extension assembly 246 to provide a user with a convenient leg exercise. Particularly, hook 242 of cable 238 is coupled to plate 234, and a second opposed end which is coupled to and terminates at generally planar portion 249 of leg extension assembly 246, and this coupling may be made by screws, by bolts, or substantially any type of connection strategy or technique. Further, cable 238 is coupled to planar portion 249 through a plurality of substantially similar pulley wheels 247, 248, with pulley wheels 247, 248 coupled to beams 68, 69 by screws, by pins, or substantially any other type of connection strategy or technique. Moreover, planar portion 249 has a generally rectangular cross section and comprises a first end 250 which is coupled to vertical beams 68, 69 by screws which are received in apertures (not shown) which traverse beams 68, 69, and a second end 251 which is coupled to a plurality of substantially similar leg pads 252, 253.

Figure 9:
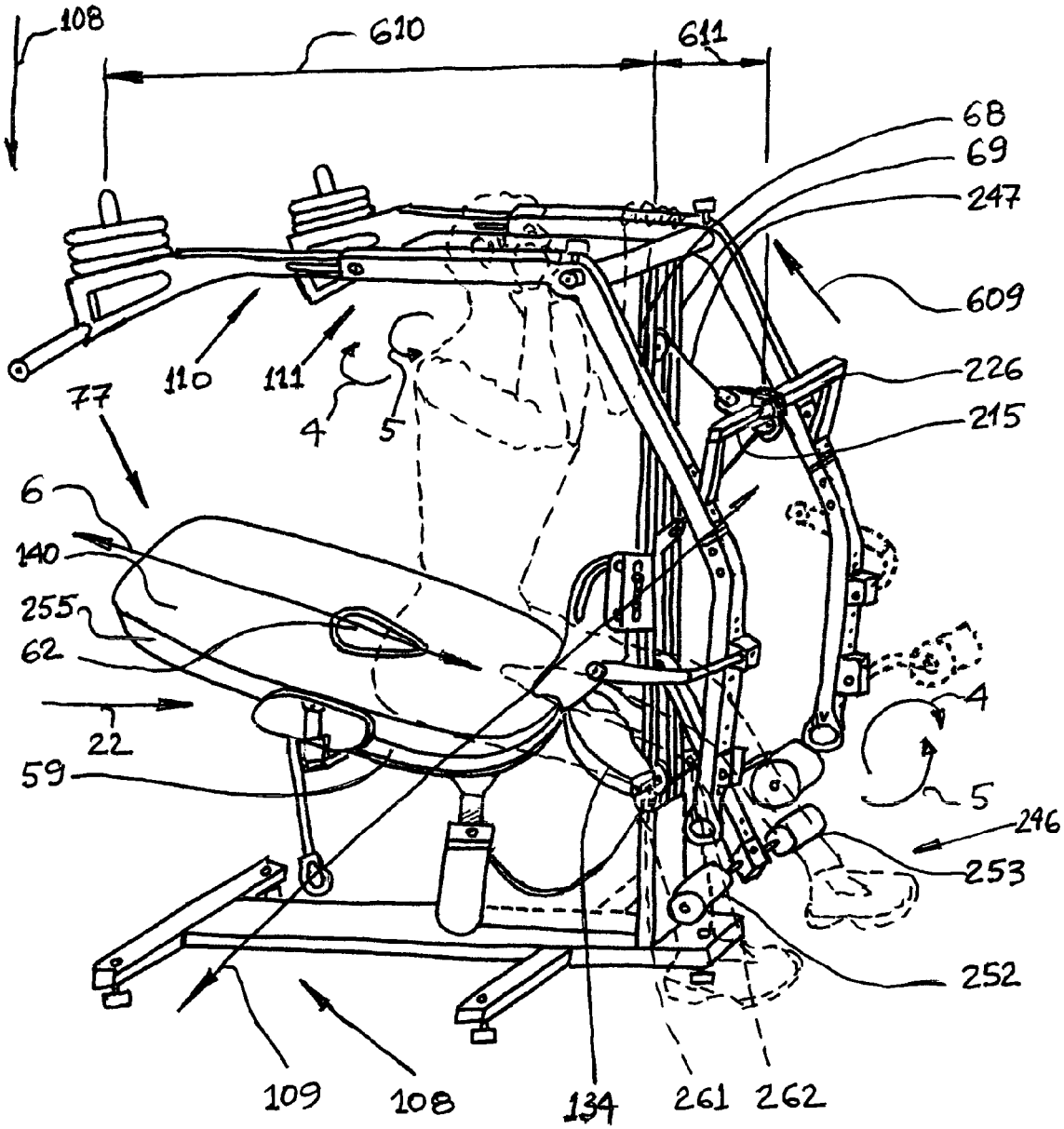
FIG. 9 is a perspective view of the exercise apparatus which is shown in FIGS. 1-2, but which is shown with the exercise apparatus being utilized as a leg press exercise apparatus.

A user would utilize leg extension assembly 246, as best shown in FIG. 9, by positioning chair assembly 22 so that leg separator pad 62 is aligned along axis 6 and anterior end 63 of buttocks pad 59 is remote from beams 68, 69 while rotating back pad assembly 77 counterclockwise along arcuate direction 5 until back pad 255 is resting on buttocks pad 59 and apertures 124, 125, 126 cooperate to receive leg separator pad 62. Further, pads 134, 135 are extended from a stored position (shown in FIG. 1) to a fully extended position (as shown) by rotating pads 134, 135 clockwise along arc 4 until pads 134, 135 are abutting and resting on pins 261, 262 (shown in FIG. 1), and pins 261, 262 prevent pads 134, 135 from further travel along arc 4. A user would begin his exercise by sitting on back pad 255 and resting his thighs on pads 134, 135 with the users shins touching substantially similar leg pads 252, 253 (i.e., with a users chest facing beams 68, 69) and selectively lifting substantially similar leg pads 252, 253 by straightening his legs which causes leg pads 252, 253 to travel counterclockwise along arc 5 and which correspondingly causes cable 247 to apply a force on rails 215, 226 in direction 609 (such as the force applied by cable pulling on rails 215, 226), and length 610 being greater than length 611 causes actuator arm assemblies 110, 111 to rotate along clockwise along arcuate direction 4. Thus, leg extension assembly 246 is effective to provide a user of exercise apparatus 10 with a convenient leg exercise so that a user utilizing exercise apparatus 10 may obtain an overall complete body exercise.

Figure 10:
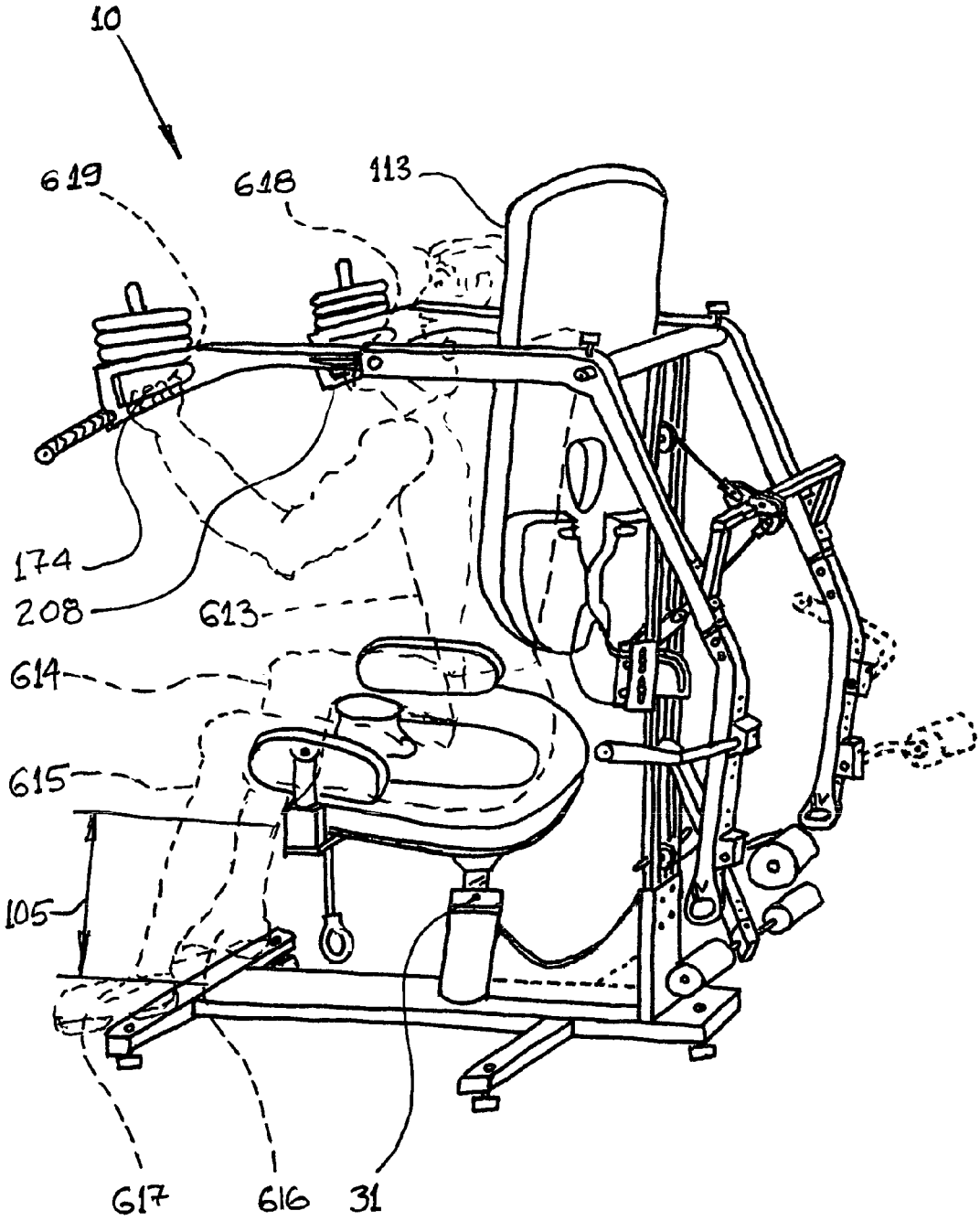
FIG. 10 is a perspective view of the exercise apparatus which is shown in FIGS. 1-2, but which is shown with the exercise apparatus being utilized as a shoulder press exercise apparatus.
Figure 11:
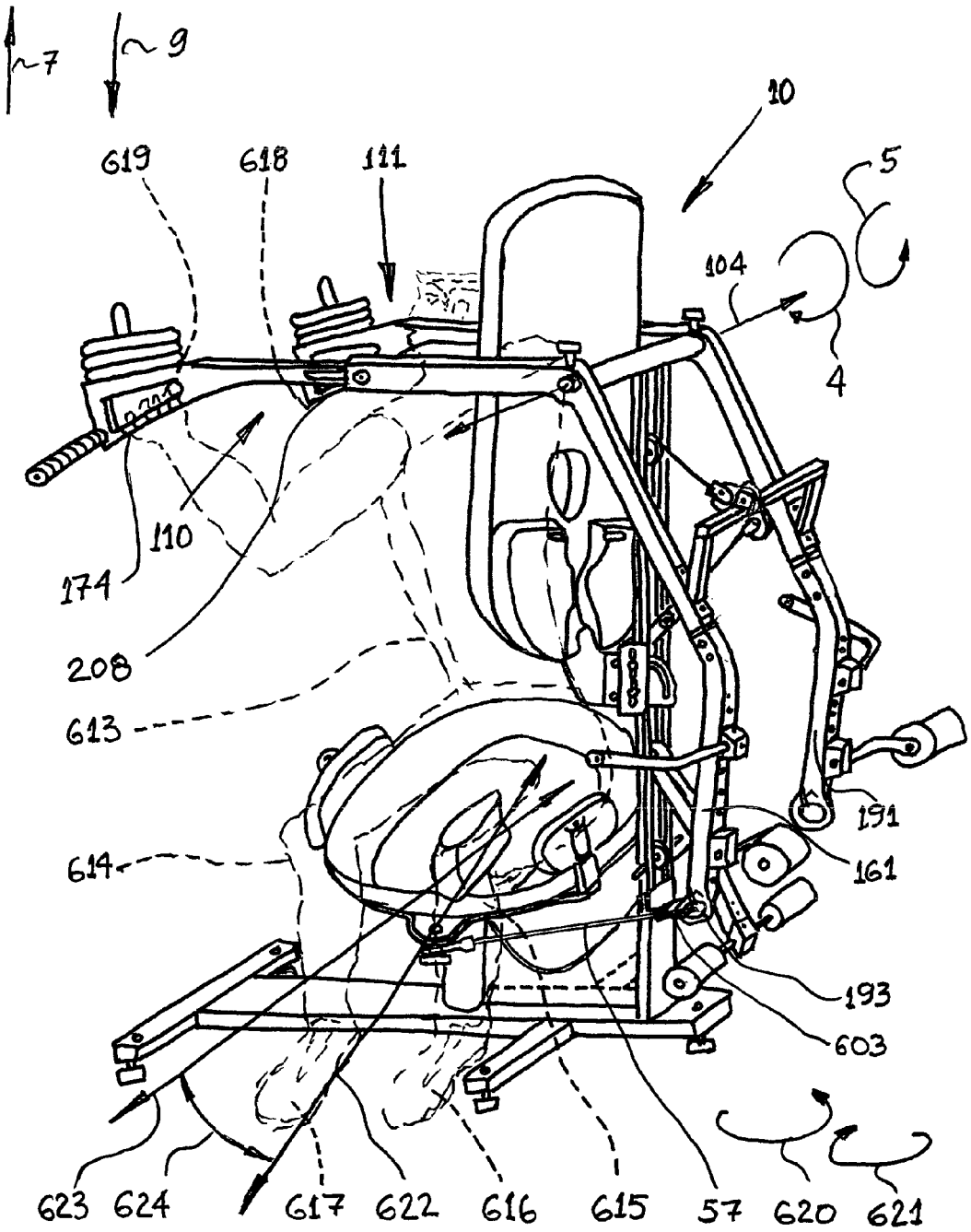
FIG. 11 is a perspective view of the exercise apparatus which is shown in FIGS. 1-2, but which is shown with the exercise apparatus connected to actuator arm assemblies and the exercise apparatus being utilized to perform arm pull, abdominal and lower back exercises.

In operation of exercise apparatus 10 in the tensile mode, and as best shown in FIGS. 10-11, a user 613 would first adjust the exercise apparatus 10 to comfortably receive and support his/her body. Particularly and as shown in FIG. 10, user 613 may selectively adjust set screw 31 to a position which either increases or decreases the height 105 of the buttocks pad 59 from center beam 12 and which allows the user 613 to comfortably rest his/her buttocks on the buttocks pad 59 and which further allows the user 613 to comfortably rest his/her feet on the ground (i.e., a user's soles are "lightly" touching the surface of the ground).

Next and as shown in FIG. 10, a user 613 may then place his/her body upon the exercise apparatus 10 by placing his/her buttocks within the buttocks pad 59 (i.e., in a seated position) and gently recline his/her back until the user's back is comfortably resting against and abutting surface 113 of back support pad 255 and hands 618, 619 are respectively gripping onto respective hand grip portion 208, 174 of respective actuator arm assemblies 111, 110. In this seated position, the leg separator pad 62 is positioned between legs 614, 615 while his/her feet 616, 617 are touching the ground surface respectively.

Next, user 613 may selectively rotate his/her body (FIG. 11) to the left along arcuate direction 620 in order to exercise the left side of the body or to the right along arcuate direction 621 in order to exercise the right side of the body. In one non-limiting embodiment and as best shown in FIG. 11, a user 613 may selectively rotate to the left along arcuate direction 620 and selectively couple cable 57 to actuator arm assembly 110 by selectively locking loop 58 to hook portion 193 of actuator arm assembly 110. It should be appreciated that, upon completion of coupling cable 57 to the actuator arm assembly 110, the leg separator pad 62 is aligned along axis 622, and pad 62 is in a position that places substantially no "torsional" force (i.e., the rotational force exerted by seat assembly 22 on user 613).

Next, user 613 may selectively rotate seat assembly 22 to a comfortable beginning position in order to exercise on apparatus 10 by rotating seat assembly 22 clockwise along arcuate direction 621 till leg separator pad is aligned along axis 623, and where axis 623 forms an angle 624 with axis 622, while concomitantly gripping hand grip portions 208, 174, and where rotation of seat assembly 22 causes actuator arm assemblies 110, 111 to move upwards in direction 7 (i.e., cable 47 exerts a pulling force on hook 193 which causes actuator arm assemblies 110, 111 to rotate clockwise 4 along axis 104). It should be appreciated that user 613 may selectively rotate along arcuate direction 621 to any desired angle 624 in order to position his/her body in a comfortable position. It should also be appreciated that, upon completion of a user 613 rotating his/her body, his/her back is abutting back support pad 255 while his/her feet are lightly touching the ground, and the user 613 is now ready to begin utilizing the exercise apparatus 10.

Next, the user 613 of the apparatus 10 may selectively pull upon the respective hand grip portions 208, 174 which causes seat assembly 22 to rotate along arcuate direction 620 thereby causing the user's lower body to move along arcuate direction 620. It should be appreciated that, in this manner, respective portions 191, 161 of respective actuator arm assemblies 111, 110 move along counterclockwise in direction 5, causing respective actuator arm assemblies 111, 110 to rotate counterclockwise in direction 5 along pivot axis 104 thereby applying a force on seat assembly 22 (i.e., the force caused by pulling against cable 57), and a tension is applied to cable 57. Upon a tension being applied to the cable 57, the cable 57 then pulls upon the seat assembly 22, and forces the seat assembly 22 to rotate along arcuate direction 620, and which causes a torsional force to be applied to a users lower body at a users abdomen.

Next, the user 613 would exercise his abdomen and his arms during a "positive" cycle of the apparatus 10 by pulling on handle grip portions 208, 174 in direction 9 which gently resisting the rotation of seat assembly 22 along arcuate direction 620, as the users lower body is rotated in arcuate direction 620 from axis 623 to axis 622. Pulling on handle grip portions 208, 174 causes a causes a "torsional" force (i.e., a rotational force) to be applied to the users abdomen by the rotation of seat assembly 22 along arc 620, thereby effective to strengthen and tighten the user 613 abdominal and lower back muscles as the user 613 gently resists this "torsional" force applied to the abdomen of user 613.

Next, the user 613 would exercise his abdomen and his arms during a "negative' cycle of the apparatus 10 by gently releasing the users hands from the respective handle grips 208, 174, and rotating seat assembly 22 from position along axis 622 to axis 623 along arcuate direction 621, thereby causing the seat assembly 22 to return to the beginning position of the exercise. It should be appreciated that a user 613 may repeat as many of the "positive" and corresponding "negative" cycles as the user 613 desires in order to strengthen users muscles in order to improve strength and flexibility.

Figure 12:
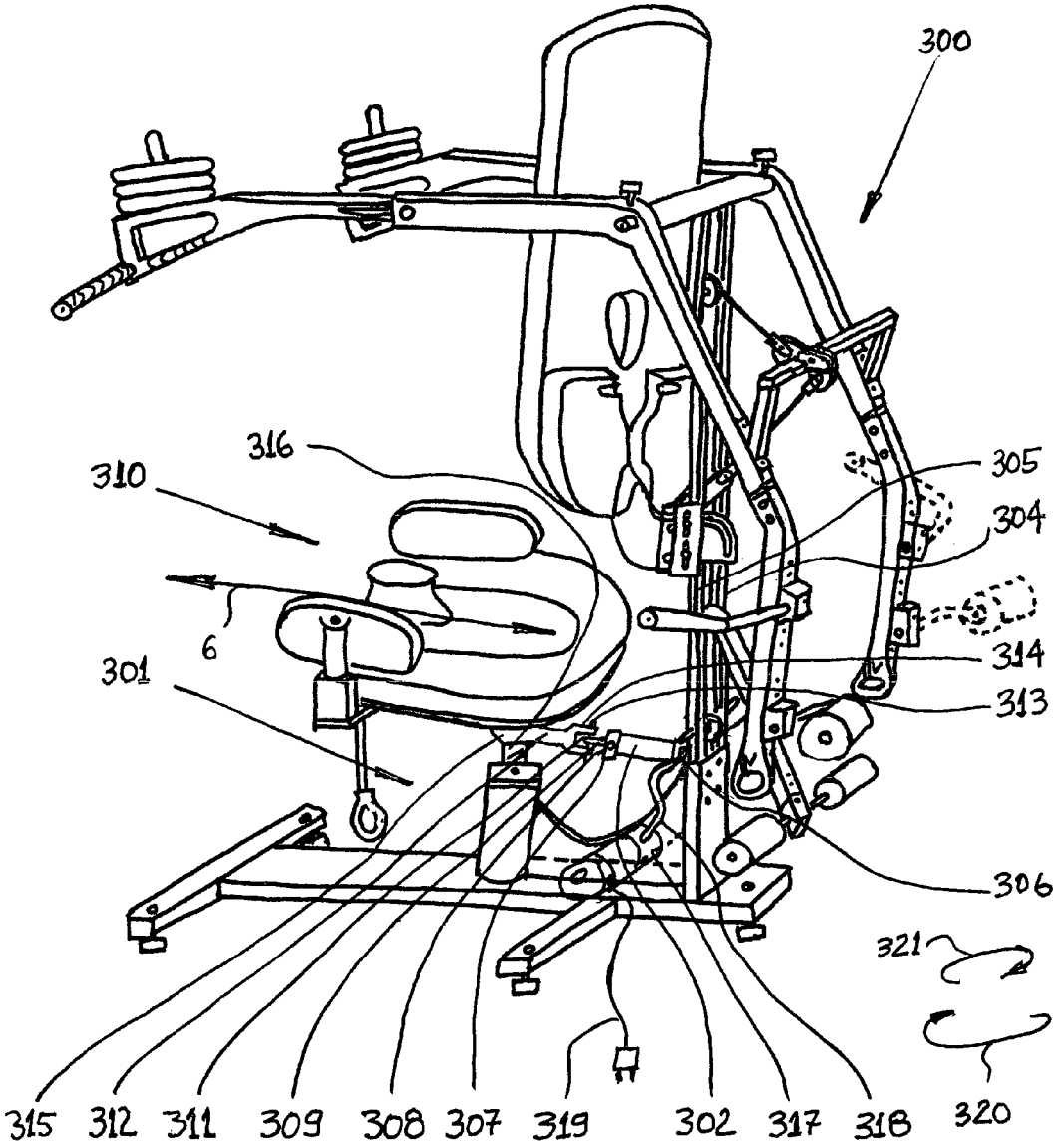
FIG. 12 is a perspective view of an exercise apparatus which is made in accordance with the teachings of another alternate embodiment of the invention.

In yet another alternate, although non-limiting, embodiment as is best perhaps shown in FIG. 12, exercise apparatus 300 comprises a pneumatic pump assembly 301 coupled to the seat assembly 310 while all other aspects of the exercise apparatus 300 remain the same as exercise apparatus 10 of the preferred embodiment. Particularly, pneumatic pump assembly 301 comprises a generally hollow and cylindrical pneumatic cylinder 302 movably coupled at closed end 303 to vertical beams 304, 305, by a "ball joint" bracket 306 which has a through aperture and which is provided to receive, in one non-limiting embodiment, a pin (not shown) which traverses bracket 306 and beams 304, 305, and which couples bracket 306 to beam 304, 305. The cylinder 302 also comprises a threaded release valve 307 disposed at end 308 and which selectively causes the air resident within pneumatic cylinder 302 to be selectively released by a program control release valve 307 in either a clockwise or counterclockwise direction. Further, pneumatic cylinder 302 has a selectively movable elongated rod 309 having a first end (not shown) operatively and slide-ably disposed within internal cavity of cylinder 302, and rod 309 having a second end 311 operatively coupled to elongated rod 312 by, in one non-limiting embodiment, a cotter pin 313 which traverses end 311 of elongated rod 309. Also, elongated rod 312 has a generally "U-shaped" first end 314 (i.e., "U-shaped" end 314 is shaped like a commercially available clevis pin) coupled to end 311 by cotter pin 313, and a second end 315 which is fixedly coupled to threaded shaft 316 of seat assembly 310.

Yet further, pneumatic pump assembly 301 further comprises a commercially available electric air compressor 317 coupled to a pneumatic cylinder 302. Particularly, compressor 317 is coupled to pneumatic cylinder 302 by an air hose 318, thereby effective to provide compressed air to pneumatic cylinder 302 via the air hose 318, by supplying electricity to compressor 317 by the use of electric cord 319. The air compressor 317 causes the pneumatic cylinder 302 to apply a force on elongated rod 309 (such as the force applied by pushing the rod away from internal cavity of pneumatic cylinder 302), and which causes elongated rod 309 to apply a concomitant force on rod 312, thereby causing rod 312 to apply a torsional force on threaded shaft 316 and causing seat assembly 310 to rotate along arcuate direction 320. It should be appreciated that rod 312 may also apply a rotational force on threaded shaft 316 along arcuate direction 321 by rotating seat assembly 310 along arcuate direction 320 and supplying electricity to compressor 317 which causes cylinder 302 to apply a force on rod 309, thereby effective to cause rod 312 to apply a torsional force on threaded shaft 316 along arcuate direction 321. Thus, a user may utilize the exercise apparatus 300 to exercise the left or the right side of the user's body.

Figure 13:
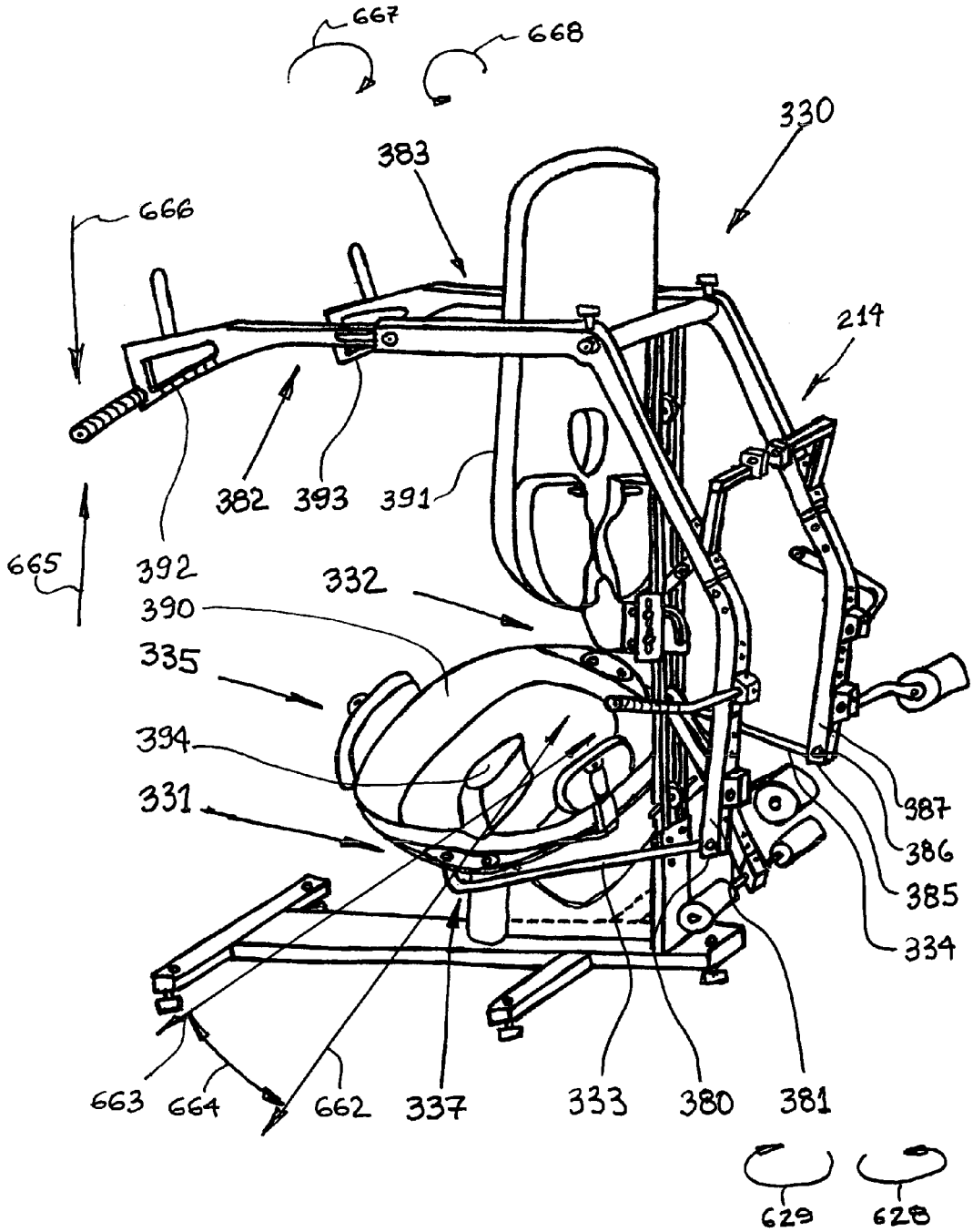
FIG. 13 is a perspective view of an exercise apparatus which is made in accordance with the teachings of yet another alternate embodiment of the invention.
Figure 14:
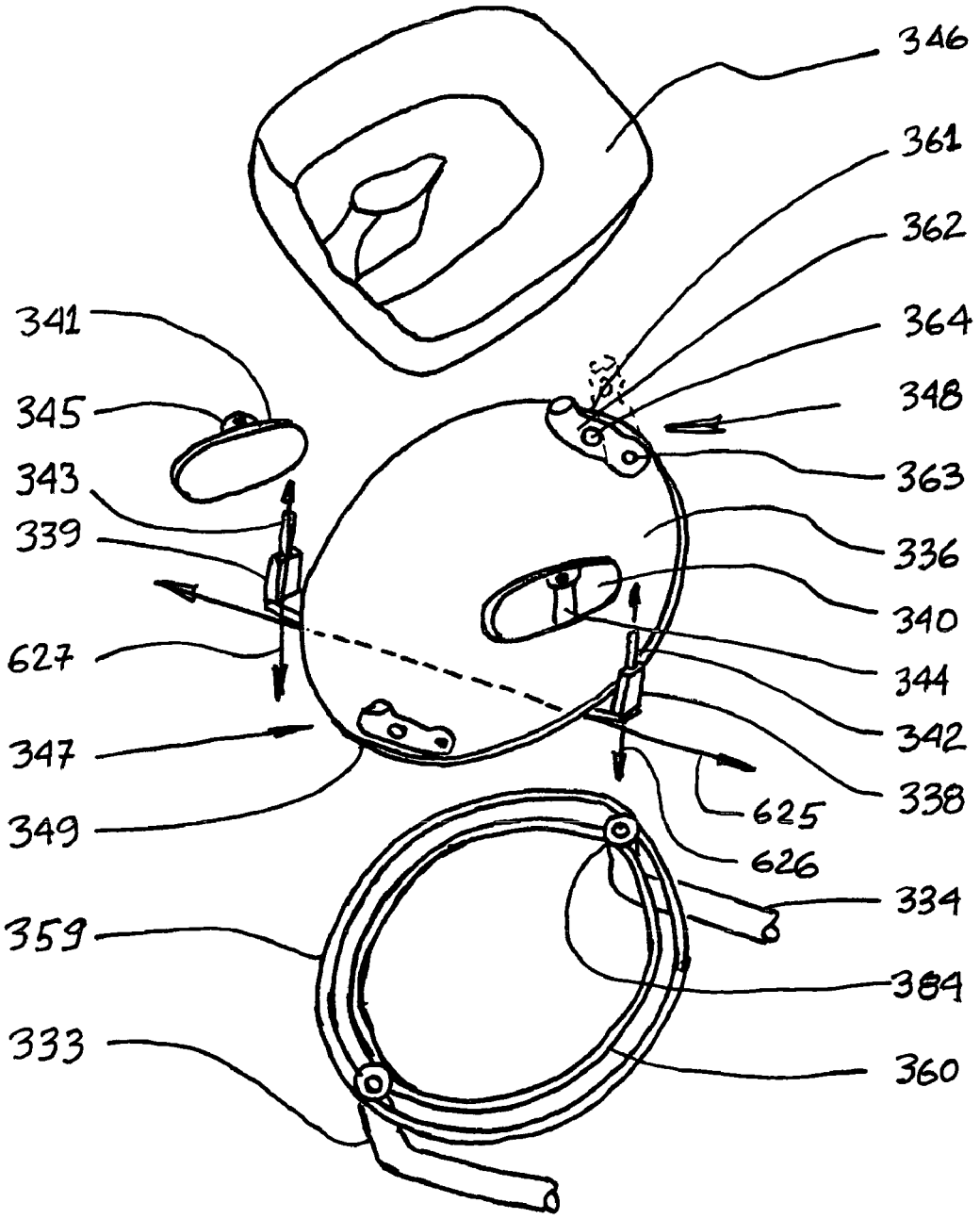
FIG. 14 is a exploded perspective view of the seat assembly of the exercise apparatus which is shown in FIG. 13.
Figure 15:
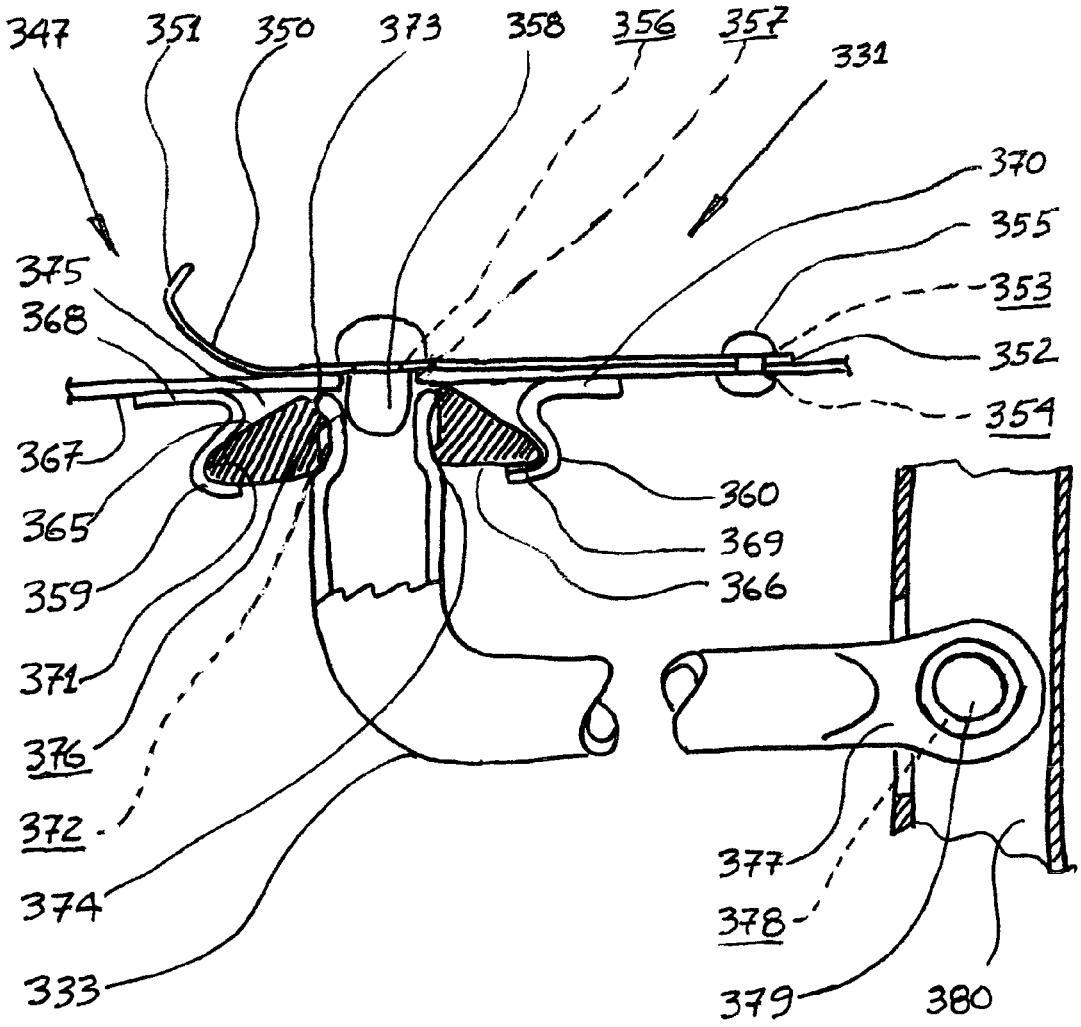
FIG. 15 is a partial cross-sectional view of the rotator striker actuator assembly of the exercise apparatus which is shown in FIG. 13.

In yet another alternate, although non-limiting, embodiment, as is best shown in FIGS. 13-15, cable 57 of the exercise apparatus 10 of the preferred embodiment as shown in FIGS. 1-2 may be replaced by a plurality of substantially similar rotator striker actuator assemblies 331, 332 and a plurality of substantially similar connecting rods 333, 334, while locator bar assembly 214 may be selectively decoupled from actuator arm assemblies 382, 383 (i.e., screw 221 is removed from apertures 220, 222 as best seen in FIG. 8 and actuator arm assembly 382 moves independently of actuator arm assembly 383), while all other aspects of the exercise apparatus 330 remain the same as exercise apparatus 10 of the preferred embodiment.

Particularly, seat assembly 335 comprises a seat frame 336 coupled to a substantially similar swivel bearing assembly 337 (FIG. 13) as bearing assembly 23 of the preferred embodiment. Further and shown in FIG. 14, seat frame 336 has a first "L-shaped" member 338 coupled to seat frame 336 at axis 625 and a second substantially similar and directly opposed "L-shaped" member 339 coupled along same axis 625. Further, respective members 338, 339, have substantially identical posts 342, 343 orthogonally coupled to respective members 338, 339 and which are provided to receive a plurality of substantially similar and rectangular leg pressure pads 340, 341. Leg pressure pads 340, 341 are coupled to members 338, 339 by respective "c-shaped" housing portions 344, 345 which contain respective cavities (not shown) and which are slide-ably coupled to respective posts 342, 343 of respective members 338, 339, and which cause respective pads 340, 341 to pivot on respective longitudinal axes 626, 627 of posts 342, 343, thereby effective to provide an even distribution of pressure by pads 340, 341 on respective legs of a user.

Yet further and as shown in FIG. 14, seat assembly 335 comprises a buttocks pad 346 which is substantially similar as buttocks pad 59 of the preferred embodiment as was shown in FIG. 1, and pad 346 having a circumference which is slightly smaller than circumference of seat frame 336. Also, seat assembly 335 has a plurality of rotator actuator assemblies 331, 332 coupled to seat frame 336. It should be appreciated that a description of rotator actuator assembly 331 provides an accurate and complete description of rotator actuator assembly 332.

Rotator actuator assembly 331 has a leaf spring assembly 347 coupled to frame 336 (i.e., leaf spring assembly 347 is coupled to anterior end 349 of frame 336. Particularly, leaf spring assembly 347 has a generally planar leaf spring portion 350 (as shown in FIG. 15) having arcuate end 351 and portion 350 being fixedly coupled to seat frame 336 at opposite end 352 and having a first through aperture 353 which is aligned with through aperture 354 of seat frame 336 and apertures 353, 354 cooperatively receive leaf spring mounting pin 355 which protrudes through apertures 353, 354 and which is effective to couple end 352 of leaf spring portion 350 to seat frame 336. Leaf spring portion 350 further comprises a second through aperture 356 which is aligned with through aperture 357 of seat frame 336 and apertures 356, 357 being provided to receive leaf spring striker pin 358 which traverses through apertures 356, 357 and which is effective to selectively latch leaf spring assembly portion 350 to seat frame 336.

Yet further and shown in FIG. 14, rotator actuator assembly 332 has a leaf spring assembly 348, coupled to frame 336 (i.e., leaf spring assembly 348 is coupled to posterior end 361 of frame 336). Particularly, leaf spring assembly 348 has a generally planar leaf spring portion 362 and being fixedly coupled to seat frame 336 by a leaf spring mounting pin 363, and which couples leaf spring portion 362 to seat frame 336. Leaf spring portion 362 further comprises a leaf spring striker pin 364 which traverses portion 362 and seat frame 336 and which is effective to selectively latch leaf spring assembly portion 362 to seat frame 336.

Yet further and as shown in FIGS. 14-15, exercise apparatus 330 has a plurality of circular housing members 359, 360 coupled to seat frame 336. That is, and shown in FIG. 15, first circular housing 359 has a generally "S-shaped" cross-section and having a "U-shaped" receptacle portion 365. Further, housing member 359 is coupled to surface 367 of seat frame 336 at end 368, and this coupling may be made by a welded connection, by screws or bolts, or substantially any other strategy or technique. Exercise apparatus 330 also has a substantially similar second "S-shaped" circular housing member 360 which is enclosed within housing member 359, and member 360 having a generally "U-shaped" receptacle portion 369, and housing members 359, 360 cooperatively receive rotary slider portion 366 within groove 375 and which will be discussed further below. Further, housing member 360 is coupled to surface 367 of seat frame 336 at end 370, and this coupling may be made by a welded connection, by screws or bolts, or substantially any other strategy or technique.

Also as previously mentioned, exercise apparatus 330 comprises a generally circular rotary slider portion 366 having a circumferential edge 371 which is received within receptacle portion 365 of housing 359 and which is also received within receptacle portion 369 of housing 360. Also, generally circular rotary slider portion 366 has a through aperture 372 which is provided to receive connecting rod 333 at first open end 373 and also provided to receive connecting rod 333 at second open end 374. It should be appreciated that connection rod 333 is fixedly coupled to slider portion 366. It should be appreciated that rotary slider portion 366 travels within and is contained within groove 375 when a user rotates on buttocks pad 346 along arcuate direction 628 or arcuate direction 629.

The exercise apparatus 330 further comprises a plurality of connecting rods 333, 334 coupled to actuator assemblies 331, 332 respectively. That is, connecting rod 333 is tubular and generally "L-shaped" and having a first open end 376 which is received within aperture 372 of slider portion 366, and end 376 receives striker pin 358 when pin 358 engages open end 376. Rod 333 also has a second end 377 which has a through aperture 378 and which is provided to receive a threaded bolt 379. Also, bolt 379 is received within a through aperture (not shown) on end 380 (FIG. 15) of planar portion 381 of generally planar portion 380 of actuator arm assembly 382 and bolt 379 is effective to couple seat assembly 335 to actuator arm assembly 382 of exercise apparatus 330. Yet further, connection rod 334 is tubular and generally "L-shaped" and having a first end 384 (FIG. 14) which resides within slider portion (not shown) of actuator rotator assembly 334 and having a second end 385 which receives a bolt 386 (FIG. 13) and which is effective to couple end 385 to portion 387 of actuator arm assembly 383.

In operation, a user may selectively rotate his/her body to the left along arcuate direction 628 in order to exercise the left side of the body or to the right along arcuate direction 629 in order to exercise the right side of the body. In one non-limiting embodiment, a user would exercise the left part of his body by lifting respective leaf spring assemblies 347, 348 and rotating chair assembly 335 in arcuate direction 628 (as best seen in FIG. 13), which causes rotary slider portion 366 or respective rotator actuator assemblies 331, 332 to slide within cavity 372 (FIG. 15) until rotary striker pin 358 of rotator actuator assembly 331 engages and resides within aperture 376, thereby causing connecting rod 333 to be selectively coupled to actuator arm assemblies 382 while rotator striker pin 358 of rotator actuator assembly 332 engages and resides within aperture 372 of slider portion 366 and causing connection rod 334 to be selectively coupled to actuator arm assembly 383. In this position, a user's buttocks are resting on the buttocks pad 390 (i.e., in a seated position) and the user's back is comfortably resting against and abutting back support pad 391 and a user's hands are respectively gripping onto respective hand grip portion 392, 393 of respective actuator arm assemblies 382, 383. Also, leg separator pad 394 is aligned along axis 662, and pad 394 is in a position that places substantially no "torsional" force (i.e., the rotational force exerted by seat assembly 335 on the user).

Next, the user may selectively rotate seat assembly 335 to a comfortable beginning position in order to exercise on apparatus 330 by rotating seat assembly 335 clockwise along arcuate direction 629 until leg separator pad 394 is aligned along axis 663, and where axis 663 forms an angle 664 with axis 662, while concomitantly gripping hand grip portions 392, 393, and where rotation of seat assembly 335 causes actuator arm assembly 382 to move upwards in direction 665 (i.e., rod 333 exerts a pulling force on end 380 which causes actuator arm assembly 382 to rotate clockwise long arcuate axis 667), and which also causes actuator arm assembly 383 to move downwards in direction 666 (i.e., rod 334 exerts a pushing force on end 385 which causes actuator arm assembly 383 to rotate counterclockwise along arcuate axis 668). It should be appreciated that the user of exercise apparatus 330 may selectively rotate along arcuate direction 629 to any desired angle 664 in order to position his/her body in a comfortable position. It should also be appreciated that, upon completion of the user rotating his/her body, his/her back is abutting back support pad 391 while his/her feet are lightly touching the ground, and the user is now ready to begin utilizing the exercise apparatus 330.

Next, the user of the apparatus 330 may selectively pull upon hand grip portions 392 while pushing upon hand grip portion 393, which causes seat assembly 335 to rotate along arcuate direction 628 thereby causing the user's lower body to move along arcuate direction 628 thereby applying a force on seat assembly 335 (i.e., the force caused by end 380 pulling against rod 333). This causes the rod 333 to pull upon the seat assembly 333 which rod 334 pushes against seat assembly, and forces the seat assembly 335 to rotate along arcuate direction 628, and which causes a torsional force to be applied to a users lower body at a users abdomen.

Next, the user would exercise his abdomen and his arms during a "positive" cycle of the apparatus 330 by gently resisting the rotation of seat assembly 335 along arcuate direction 628, as the users lower body is rotated in arcuate direction 628 from axis 663 to axis 664. Pulling on handle grip portion 392 causes a causes a "torsional" force (i.e., a rotational force) to be applied to the users abdomen by the rotation of seat assembly 335 along arc 628, thereby effective to strengthen and tighten the user's abdominal muscles as the user gently resists this "torsional" force applied to the abdomen.

Next, the user would exercise his abdomen and his arms during a "negative' cycle of the apparatus 330 by gently releasing the users hands from handle grip 392 while pulling down on handle grip 393, which causes seat assembly 335 to rotate from position along axis 662 to axis 663 along arcuate direction 629. The user would exercise his abdomen by gently resisting the rotation of seat assembly 335 as the users lower body is rotated along arcuate direction 629 and causing seat assembly 335 to return to the beginning position of the exercise. It should be appreciated that a user may repeat as many of the "positive" and corresponding "negative" cycles as the user desires in order to strengthen the users muscles in order to improve strength and flexibility. It should be appreciated that in an alternate but non-limiting embodiment, rotator actuator assembly 332 may be also be selectively placed in a disengagement position (as shown in FIG. 14) by rotating leaf spring assembly 348 until rotator striker pin 358 is removed from aperture 372 and pin 358 resides in a non-contact position from seat frame 336.

Figure 16:
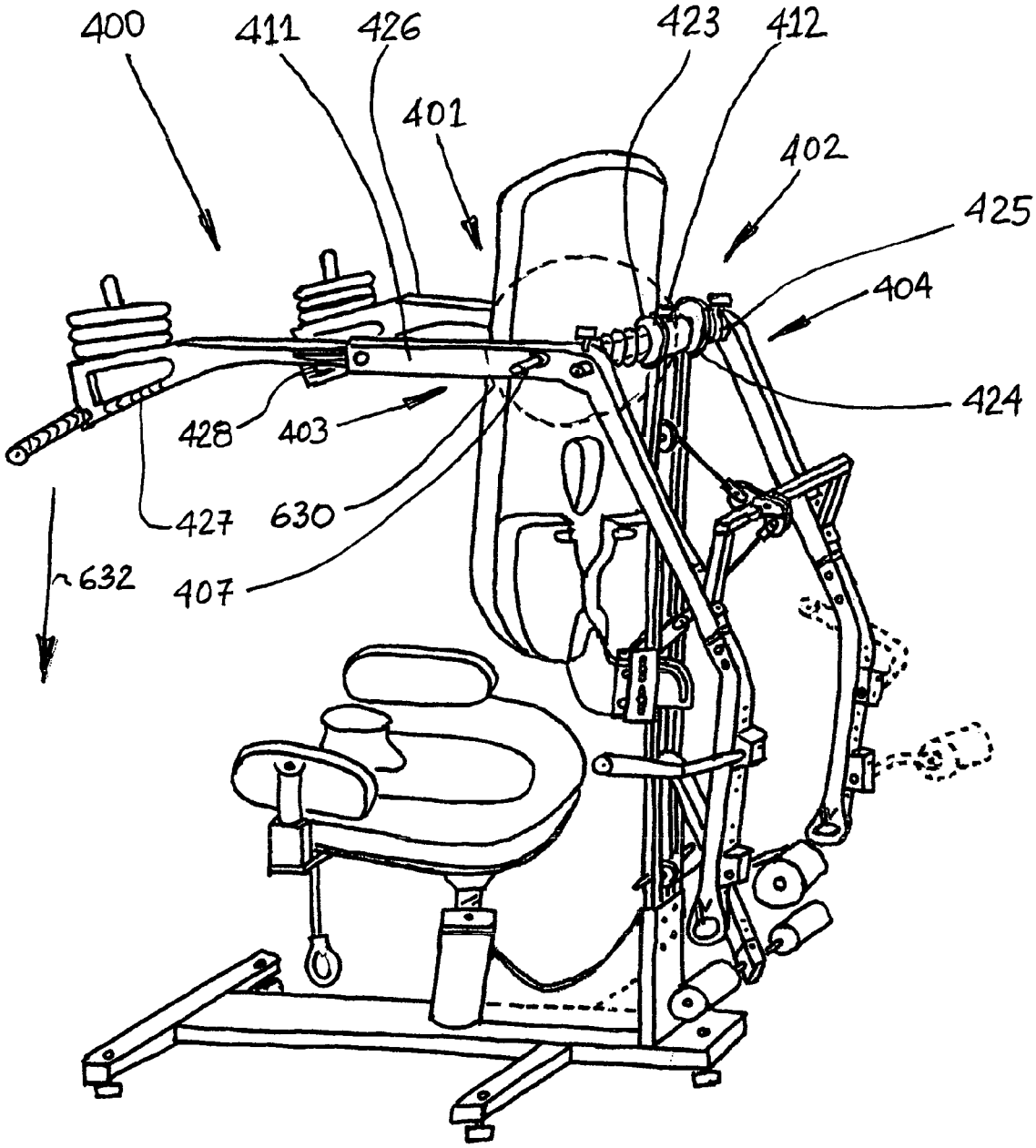
FIG. 16 is a perspective view of an exercise apparatus which is made in accordance with the teachings of yet another alternate embodiment of the invention.
Figure 17:
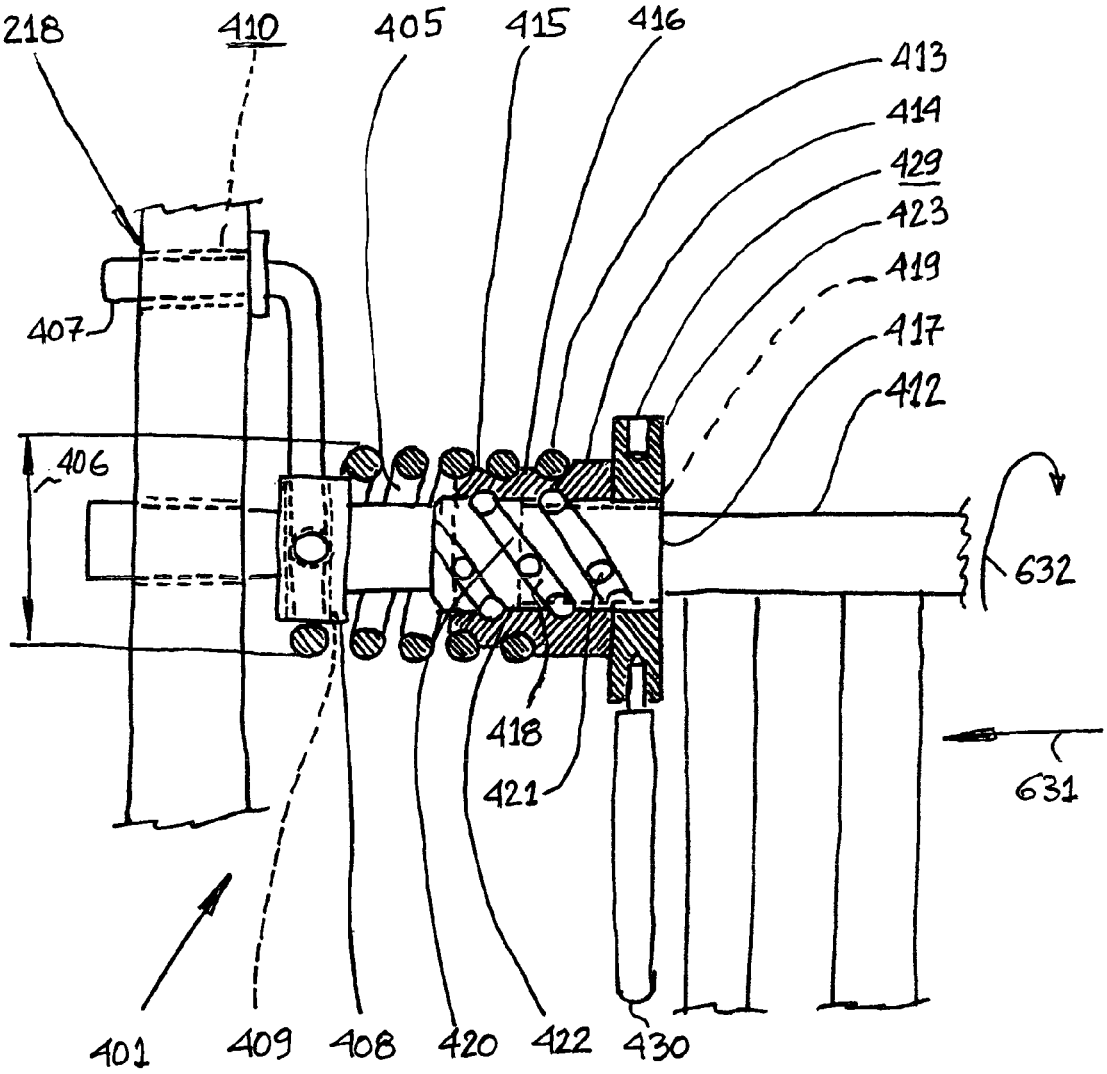
FIG. 17 is a partial cross-sectional view of the coil spring assembly which is referenced as 630 in FIG. 16 of the alternate embodiment of the invention.

In yet another alternate, although non-limiting, embodiment as is best perhaps shown in FIGS. 16 and 17, exercise apparatus 400 comprises a plurality of substantially similar and selectively adjustable coil spring assemblies 401, 402 coupled to actuator arm assemblies 403, 404 while all other aspects of the exercise apparatus 400 remains the same as exercise apparatus 10 of the preferred embodiment and as was best shown in FIGS. 1-2 (i.e., coil spring assembly 401 is coupled to actuator arm assembly 403 and coil spring assembly 402 is coupled to actuator arm assembly 404) It should be appreciated that the description of coil spring assembly 401 provides an adequate and complete disclosure for substantially similar coil spring assembly 402.

Particularly, and as best shown in FIG. 17, coil spring assembly 401 comprises a first coil spring 405 having internal diameter 406, and which receives horizontal frame member 412. Particularly, coil spring 405 has a first end 407 which is slidably coupled to tubular portion 411 of actuator arm assembly 403. That is, coil spring 405 traverses through aperture 409 of a generally cylindrical sleeve guide member 408 (i.e., sleeve guide member 408 is generally "O-shaped"), with spring 405 nested in groove 409. Also, coil spring 405 terminates in a generally "L-shaped" portion having first end 407 which is slidably received within aperture 410, with aperture 410 traversing through portion 411 of actuator arm assembly 403. Hollow sleeve guide member 408 is slidably coupled to horizontal frame member 412, and is effective to locate generally "L-shaped" portion of coil spring 405.

Yet further, coil spring 405 has a second end 413 circumferentially coupled to a spring seat 414. Particularly, spring seat 414 is generally cylindrical in shape, and having a plurality of circumferential grooves 415 on outer surface 416, and which cause coil spring 405 to seat within grooves 415. Also, spring seat 414 has a plurality of circumferential groove 420 on internal surface 422, and which has a plurality of pins, such as pin 421, which traverse seat 414 (i.e., pin 421 is orthogonal to surface 416 and couples surface 416 with surface 422), thereby effective to couple coil spring 405 to spring seat 414.

Yet further, spring seat 414 is thread-ably coupled to a spring seat actuator member 417. Particularly, spring seat actuator member 417 is generally cylindrical and is fixedly coupled to horizontal frame member 412, and member 417 having a first coarsely threaded surface 418 which receives complementary coarse-threaded internal surface of spring seat 414, and a second finely threaded surface 419 which is threadably coupled to and receives complementary threaded internal surface of threaded nut 423, and which will be described below. It should be appreciated that spring seat actuator member 417 may be coupled to horizontal frame member 412 by a welded connection, by screws, by pins, or by substantially any type of connection strategy or technique. As mentioned previously, threaded nut 423 is generally "O-shaped" and having an aperture (not shown) which receives threaded surface 419 of spring seat actuator member 417. Threaded nut 423 has a complementary threaded surface (not shown) which is coupled to threaded surface 419, thereby effective to cause threaded nut 423 to travel in direction 631 when nut is rotated along arcuate axis 632. Thus, a user would increase the downward force applied by the spring assembly 401 on actuator arm assembly 403 by rotating threaded nut 423 along arcuate axis 632, and which causes nut to travel in linear direction 631. The nut 414 will further cause spring seat member 416 to rotate along same arcuate axis 632 as spring seat member 416 travels in direction 631, thereby effective to cause spring 405 to be wound tighter (i.e., reducing the internal diameter 406 of spring 405). The winding of spring 405 causes end 407 to be rotated in direction of arcuate axis 632, and which causes end 407 to apply a complementary vertical force (i.e., a downward force) in direction 632, thereby providing additional resistance to a users left arm when he/she pushes on handle member 427 of exercise apparatus 400, as was shown and described in the preferred embodiment in FIGS. 1-2.

In an alternate but non-limiting embodiment as is best shown in FIG. 17, nut 423 comprises a plurality of apertures, such as aperture 429, and which receives a plurality of elongated spanner portions, such as elongated spanner portion 430, and which is effective to assist a user of exercise apparatus 400 to provide additional torque (i.e., rotational force) on nut 423, and thereby cause nut 423 to further travel in direction 631 and causing spring seat 414 to more tightly wind (i.e., reduce the internal diameter 406) coil spring 405.

Also as shown in FIG. 16, exercise apparatus 400 also comprises a substantially similar coil spring assembly 402 which is similarly and circumferentially coupled to horizontal frame member 412 and having a threaded nut 424 which causes coil spring 425 to apply a downward force on tubular portion 426 of actuator arm assembly 404, thereby providing additional resistance to a users arms when he/she pushes on handle member 428 of exercise apparatus 400, as was shown and describes in the preferred embodiment in FIGS. 1-2. It should be appreciates that the downward force applied by respective coil springs 405, 425 on respective actuator arm assemblies 403, 404 also complements the force a user applies on handle members 427, 428 when pulling downwards in direction 632, thereby effective to assist weaker users of exercise apparatus 400 in the downward motion. It should also be appreciated that a user of exercise apparatus 400 may selectively determine the amount of assistance required by selectively rotating respective nuts 423, 424 of respective coil spring assemblies 401, 402.

In yet another alternate but non-limiting embodiment and as best shown in FIGS. 18-21, exercise apparatus 700 comprises a frame assembly 710 coupled to a plurality of actuator arm assemblies 750, 770, thereby providing exercise apparatus 700 to be adapted to be utilized as an office chair as well as an exercise apparatus.

Particularly, frame assembly 710 has a generally planar center rail 711 having a rectangular cross-section and being orthogonally coupled at first end 713 to a second generally planar rail 712 (i.e., rail 712 forms generally a 90 degree angle with rail 711), and rail 711 is also orthogonally coupled at second opposed end 715 to a third generally planar rail 714 (i.e., rail 714 forms generally a 90 degree angle with rail 711), and this coupling may be made by a welded connection, by bolts, by screws, or substantially any type of connection strategy or technique. Also, frame assembly 710 has a plurality of "non-marking" anti-slip and selectively adjustable screws, such as screw 716 (i.e., rail 712 has a plurality of screws 716 coupled along longitudinal end and rail 714 has a plurality of screws 716 coupled at longitudinal end) and selectively adjustable screw, such as screw 716 is received within through apertures (not shown), thereby effective to selectively adjust height of base frame assembly 710 so that exercise apparatus 700 securely and frictionally contacts with the floor surface (e.g., substantially any desired surface, such as concrete, carpet, tile, and/or like) and this prevents exercise apparatus 700 from rocking or vibrating during repetitive motions of a user during use of the exercise apparatus 700, which will be described below.

Further, exercise apparatus 700 has a plurality of vertical beams 725, 726, 727 coupled to center rail 711. Particularly, vertical beam 725 is generally tubular in shape and having a rectangular cross-section and which encloses a cavity (not shown) which is coextensive along longitudinal height 634 of beam 725. Further, beam 725 is orthogonally coupled to center rail 711 at second end 728, and beam 725 is coupled to and receives substantially identical vertical beams 726, 727 which are received within cavity of beam 725, and beams 726, 727 are fixedly coupled to beam 725 by, in one non-limiting embodiment, substantially identical pins (not shown) which are disposed through beams 726, 727 and which are effective to secure vertical beams 726, 727 to beam 725, although in another non-limiting embodiment, beams 726, 727 may be coupled to beam 725 by screws, by a welded connection, or by substantially any other type of connection strategy or technique. Yet further, respective beams 726, 727 orthogonally emanate from cavity of beam 725 in direction 701 and terminate into a generally "C-shaped" member 803 at respective ends 732, 733, and this coupling is made by a plurality of pins, such as pin 806, which traverse beams 726, 727, and which will be described below.

Yet further, exercise apparatus 700 has a generally "trapezoidal" base support 720 having a first edge 721 coupled to center rail 711, a second edge 722 coupled to column 724 of chair assembly 734 (which will be described below), and a third edge 723 coupled to vertical beam 725. Base support 720 provides structural integrity to exercise apparatus 700 by reinforcing the coupling of vertical beam 725 to center rail 711 and preventing vertical beam 725 from bowing or flexing caused by vibrations generated by the exercise apparatus 700 during utilization by a user.

Figure 19:
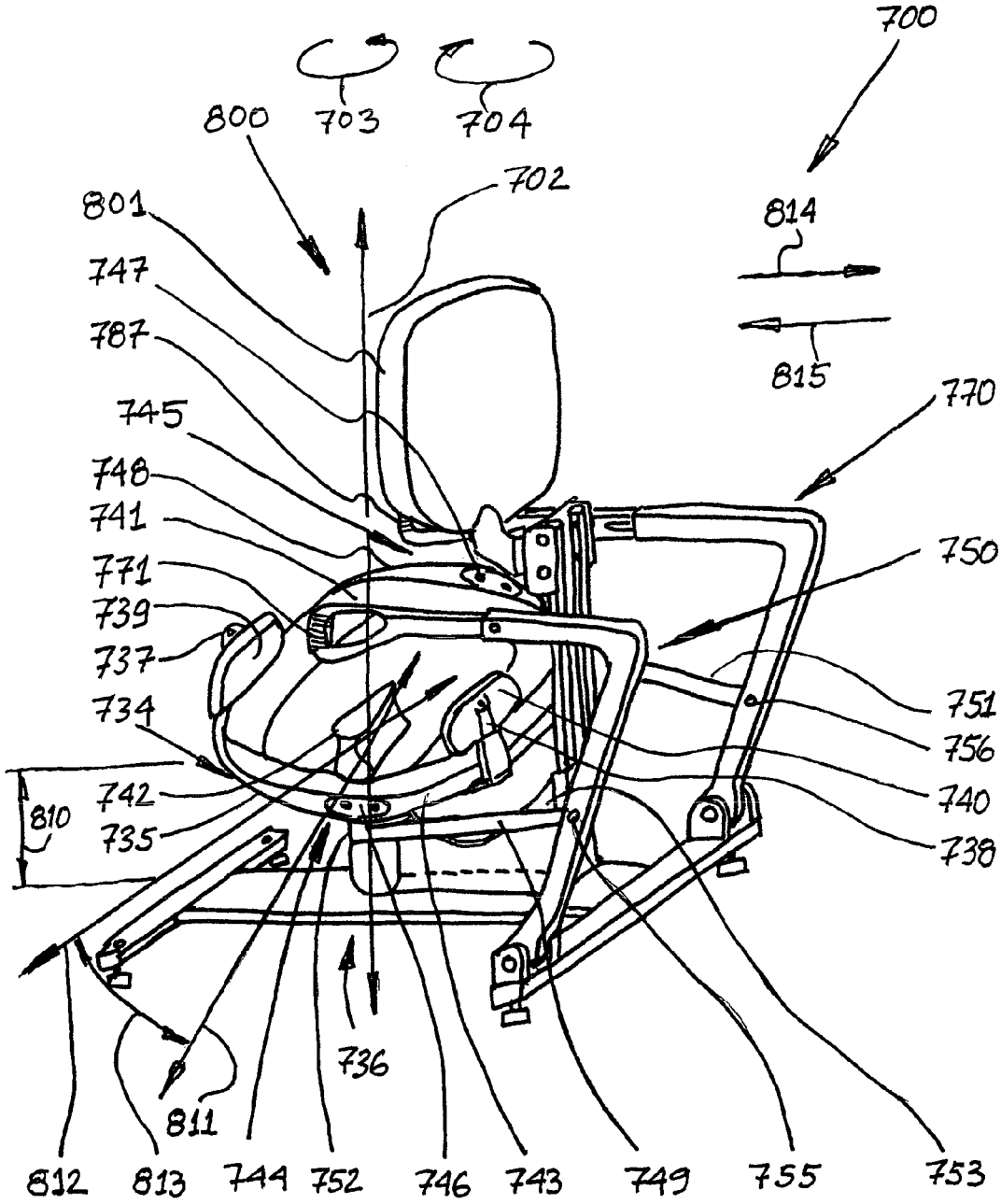
FIG. 19 is a perspective view of an exercise apparatus which is shown in FIG. 18 which is made in accordance with the teachings of an alternate embodiment of the invention.

FIG. 19 shows exercise apparatus 700 comprising a substantially similar seat assembly 734 as seat assembly 335 of an alternate but non-limiting embodiment and as was best shown in FIGS. 13-15. Particularly, seat assembly 734 comprises a seat frame 735 coupled to a bearing assembly 736, which was previously shown and described in FIGS. 13-15, and bearing assembly 736 causes seat frame 735 to rotate along arcuate direction 703 or arcuate direction 704 along pivot axis 702. Yet further, seat frame 735 has a plurality of first and second "L-shaped" members 737, 738 coupled to seat frame 735, and respective members 737, 738 are slideably and pivotally coupled to a plurality of substantially similar leg pressure pads 739, 740, and which causes pads 739, 740 to contact a users thighs when a user places his buttocks on buttocks pad 741 thereby cushioning a users thighs during use of the exercise apparatus 700.

As was previously best shown in FIG. 19, seat assembly 734 comprises a substantially similar buttocks pad 741 as buttocks pad 346 of the embodiment best seen in FIGS. 13-15, and pad 741 having a leg separator pad 742 at anterior end 743 of seat assembly 734. Also, seat assembly 734 comprises a plurality of substantially similar rotator actuator assemblies 744, 745 coupled to seat frame 435, and rotator actuator assemblies are substantially the same as rotator actuator assemblies 331, 332 of the alternate but non-limiting embodiment as shown in FIGS. 13-15. Particularly, actuator assembly 744 has a leaf spring assembly 746 coupled to frame 735 (i.e., leaf spring assembly 746 is coupled to anterior end 743 of seat frame 735) and leaf spring assembly 747 is coupled to posterior end 748 of frame 735. It should be appreciated that rotator actuator assemblies 744, 745 are substantially the same as actuator assemblies 331, 332, and the disclosure of actuator assemblies 331, 332 provides a complete disclosure as actuator assemblies 744, 745.

The seat assembly 734 further comprises a plurality of substantially similar connecting rods 749, 751 coupled to respective rotator actuator assemblies 744, 745 (i.e., rod 749 is coupled to actuator assembly 744 and rotator assembly 750, and rod 751 is coupled to rotator actuator assembly 745 and rotator arm assembly 770). Particularly, connecting rod 749 is tubular and generally "L-shaped" and having a first end 752 coupled to actuator assembly 744 and a second end 753 having a through aperture (not shown) which traverses end 753 and which receives a threaded bolt 755, thereby effective to couple rotator actuator assembly 744 to actuator arm assembly 750 of exercise apparatus 700, while connecting rod 751 is coupled to rotator actuator assembly 745 at one end and a second end having a through aperture (not shown) which traverses rod 751 and which receives a substantially similar threaded bolt 756, and which is effective to couple rotator actuator assembly 745 to rotator arm assembly 770 of exercise apparatus 700.

Figure 18:
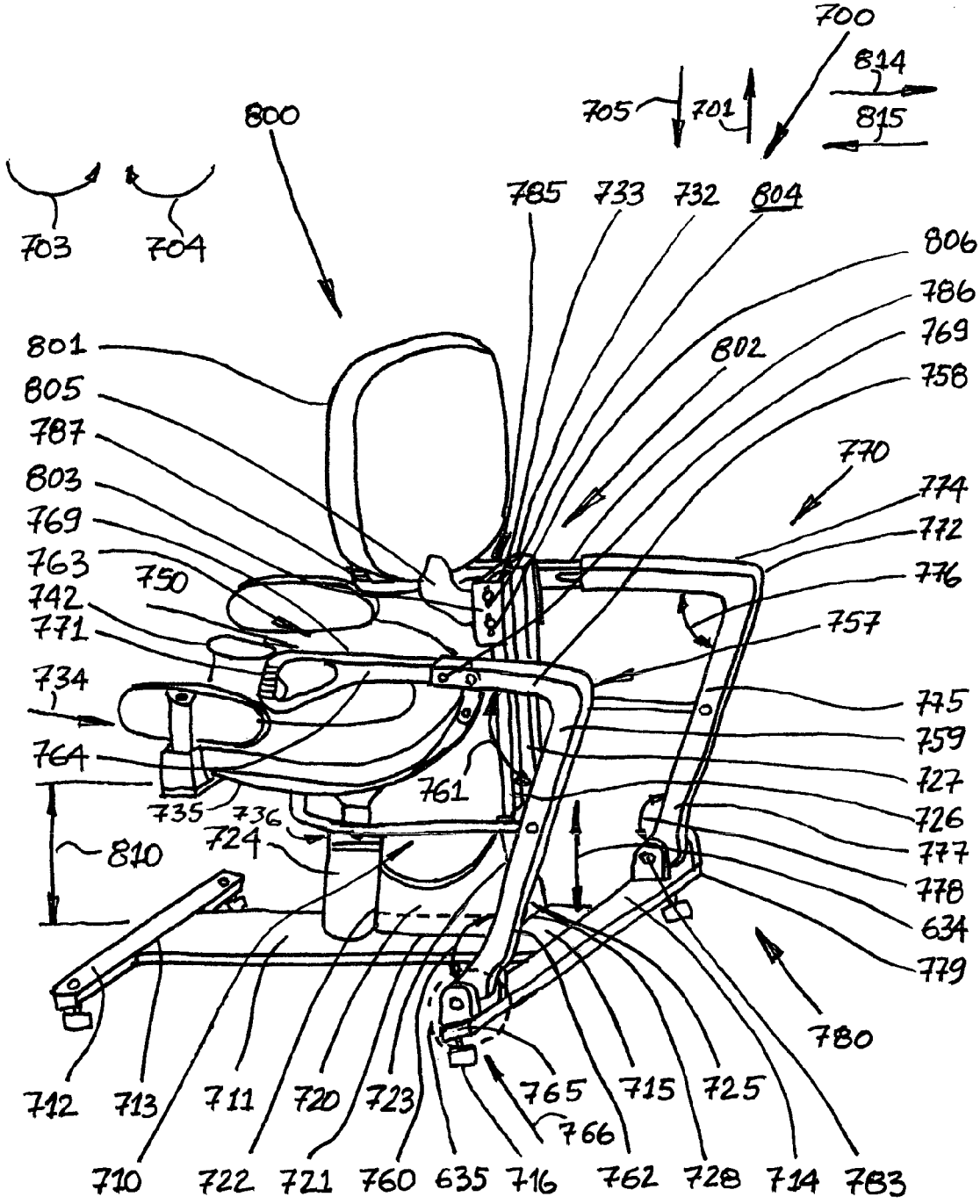
FIG. 18 is a perspective view of an exercise apparatus which is made in accordance with the teachings of yet another alternate embodiment of the invention.

Yet further, and as shown in FIG. 18, exercise apparatus 700 comprises a selectively movable back pad assembly 800 which is coupled to vertical beams 726, 727. As shown, the back pad assembly 800 includes a generally rectangular back support pad 801 fixedly coupled to a bracket assembly 802 comprising a selectively movable "C-shaped" member 803 having a plurality of opposed apertures, such as aperture 804. Also, "C-shaped" member 803 is disposed to receive vertical beams 726, 727 and couples back support pad 801 to vertical beams 726, 727 by coupling member 805 to back support pad 801 and further coupling member 805 to beams 726, 727 by a plurality of pins, such as pin 806 which traverses member 803 and further traverses beams 726, 727. It should be appreciated that back support pad 801 may be selectively movable by selectively moving "C-shaped" member 803 vertically upward in direction 701 or vertically downward in direction 705 by moving pin 805 within elongated aperture, such as aperture 804, so as to selectively adjust height of back pad 801.

Yet further and as shown in FIG. 18, exercise apparatus 700 comprises a plurality of actuator arm assemblies 750, 770 pivotally coupled to frame assembly 710. It should be appreciated that actuator arm assembly 750 is substantially the same as actuator arm assembly 770, and a disclosure of actuator arm assembly 750 provides a complete and adequate disclosure for actuator arm assembly 770.

Particularly, actuator arm assembly 750 has a first generally "L-shaped" tubular member 757 having a rectangular cross-section. Further, member 757 has a first planar portion 758, and portion 758 terminates into second planar portion 759 with portion 759 forming an acute angle 761 with portion 758. Also, portion 759 terminates into a generally planar and tubular portion 762, with portion 762 forming an angle 760 with portion 759. Moreover, portion 762 is coupled to rail 714 at end 765 of rail 714 by arm attachment assembly 766.

Figure 20:
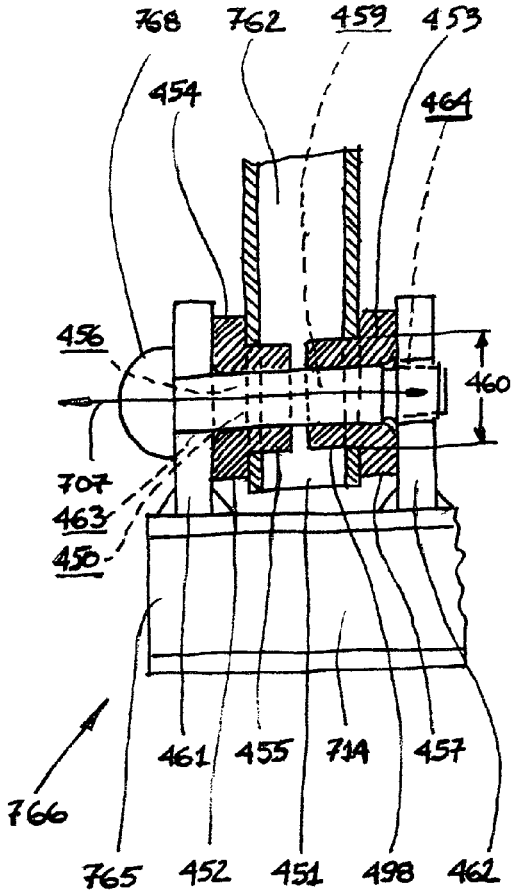
FIG. 20 is a partial cross-sectional view of the arm attachment assembly which is referenced as 635 in FIG. 19 of the alternate embodiment of the invention.

Particularly, and best shown in FIG. 20, attachment assembly 766 comprises an aperture 450 which traverses through end 451 of portion 762 along horizontal axis 707, and aperture 450 is provided to receive a plurality of substantially similar and generally "cylindrical-shaped" bearings 452, 453, with bearings 452, 453 having a circular cross-section. Particularly, bearing 452 has a first generally cylindrical portion 454 which terminates into a second generally cylindrical portion 455. Further, bearing 452 encloses an aperture 456 which traverses through portions 454, 455. Also, substantially similar bearing 453 has a first generally cylindrical portion 457, and which terminates into a second generally cylindrical portion 458. Also, bearing 453 encloses an aperture 459 which traverses through portions 457, 458. It should be appreciated that aperture 450 has a width 460 which is slightly greater than width of portion 455 of bearing 452, and width 460 is slightly greater than width of portion 458 of bearing 453, with aperture 450 receiving respective portions 455, 458 of respective bearings 452, 453.

Yet further, attachment assembly 766 comprises a plurality of generally "rectangular-shaped" members 461, 462 which are coupled to end 765 of rail 714. Member 461 has an aperture 463 which traverses through member 461 and aperture 463 being aligned along axis 707, while member 462 has a threaded aperture 464 (i.e., with circumferential threads formed along inside surface of aperture) also aligned along axis 707. Member 762, bearings 452, 453, and members 461, 462 cooperatively receive threaded bolt 768, with threaded bolt 768 traversing apertures 463, 456, 450, 459, and 464 to pivotally couple portion 762 to rail 714. It should be appreciated that axis 707 becomes the axis of rotation of actuator arm assembly 750 as actuator arm assembly 750 is rotated clockwise along arcuate direction 704 or counterclockwise along arcuate direction 703 (shown in FIGS. 18-19).

Yet further and as shown in FIG. 18, actuator arm assembly 750 comprises a second generally "L-shaped" member 763 coupled to a generally "L-shaped" portion 757. Particularly, member 763 has a first generally solid portion 764 selectively coupled to portion 758 by a pin 769. Further, member 763 terminates into a generally "triangular" shaped handle portion 771. Handle portion 771 is effective to cause actuator arm assembly 750 to be moved clockwise along arcuate direction 704 or counterclockwise along arcuate direction 703 when handle portion 771 is moved by a user (i.e., by a force applied by the hands of a user on portion 771) when portion 771 is moved in direction 815 or in direction 814.

Similarly actuator arm assembly 770 has a first generally "L-shaped" tubular member 772 having a rectangular cross-section. Particularly, member 772 has a generally planar portion 774, and portion 774 terminates into a planar portion 775, with portion 775 forming an acute angle 776 with portion 774. Also, portion 775 terminates into a generally planar portion 777, with portion 775 forming an angle 778 with portion 777. Moreover, portion 777 is coupled to rail 714 at end 779 of rail 714, and this coupling is made by an arm attachment assembly 780.

Figure 21:
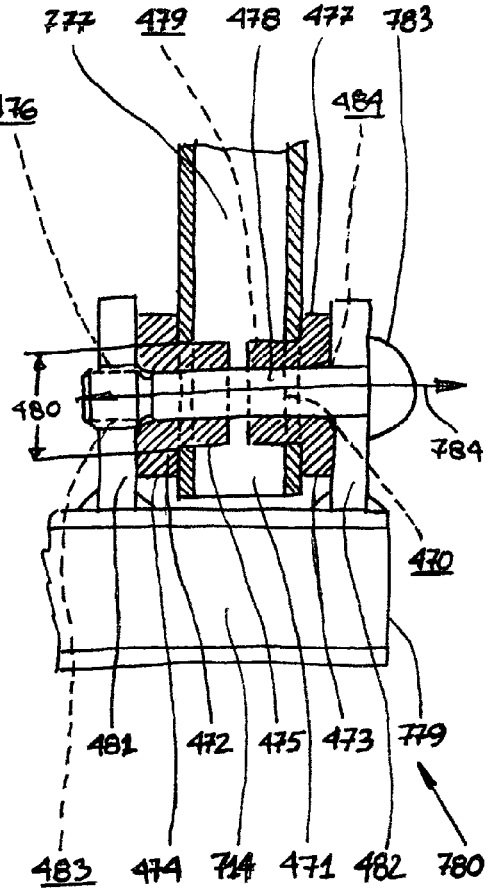
FIG. 21 is a partial cross-sectional view of the arm attachment assembly which is referenced as 670 in FIG. 19 of the alternate embodiment of the invention.

Particularly, and best shown in FIG. 21, arm attachment assembly 780 comprises an aperture 470 which traverses through end 471 of portion 777 along horizontal axis 784, and aperture 470 is provided to receive a plurality of substantially similar and generally "cylindrical-shaped" bearings 472, 473, with bearings 472, 473 having a circular cross-section. Particularly, bearing 472 has a first generally cylindrical portion 474 which terminates into a second generally cylindrical portion 475. Further, bearing 472 encloses an aperture 476 which traverses through portions 474, 475. Also, substantially similar bearing 473 has a first generally cylindrical portion 477, and which terminates into a second generally cylindrical portion 478. Also, bearing 473 encloses an aperture 479 which traverses through portions 477, 478. It should be appreciated that aperture 470 has a width 480 which is slightly greater than width of portion 475 of bearing 472, and width 480 is slightly greater than width of portion 478 of bearing 473, with aperture 470 receiving respective portions 475, 478 of respective bearings 472, 473.

Yet further, attachment assembly 780 comprises a plurality of generally "rectangular-shaped" members 481, 482 which are coupled to end 779 of rail 714. Member 481 has a threaded aperture 483 (i.e., with circumferential threads formed along inside surface of aperture) which traverses through member 481 and aperture 483 being aligned along axis 784, while member 482 has an aperture 484 also aligned along axis 784. Member 777, bearings 472, 473, and members 481, 482 cooperatively receive threaded bolt 783, with threaded bolt 783 traversing apertures 483, 476, 470, 479, and 484 to pivotally couple portion 777 to rail 714. It should be appreciated that axis 784 becomes the axis of rotation of actuator arm assembly 770 as actuator arm assembly 770 is rotated clockwise along arcuate direction 704 or counterclockwise along arcuate direction 703 (shown in FIGS. 18-19).

Yet further and seen in FIG. 18, actuator arm assembly 770 comprises a second generally "L-shaped" member 785 which is substantially the same as member 763 of the actuator arm assembly 750, and member 785 has a first portion 786 which is selectively coupled to portion 774 by a pin (not shown). Further, portion 786 terminates into a generally "triangular" shaped handle portion 787. Handle portion 787 is effective to cause actuator arm assembly 770 to be moved clockwise along arcuate direction 704 or counterclockwise along arcuate direction 703 when handle portion 787 is moved by a user (i.e., by a force applied by the hands of a user on portion 787) when portion 787 is moved in direction 815 or in direction 814.

In operation and best shown in FIG. 19, a user would first adjust the exercise apparatus 700 to comfortably receive and support his/her body. That is, a user may selectively adjust seat assembly 734 to a position which either increases the height 810 of the buttocks pad 741 in direction 701 or decreases the height of the buttocks pad 741 in direction 705 from center beam 711 and which allows the user to comfortably rest his/her buttocks on the buttocks pad 741 and which further allows the user to comfortably rest his/her feet on the ground (i.e., a users soles are "lightly" touching the surface of the ground).

Next, a user may then place his/her body upon the exercise apparatus 700 by placing his/her buttocks within the buttocks pad 741 (i.e., in a seated position) and gently recline his/her back until the user's back is comfortably resting against and abutting the back support pad 801. In this seated position, the leg separator pad 742 is positioned between the users legs while his/her legs are touching the ground surface.

Next, the user may selectively rotate his/her body either in a respective clockwise direction 704 or a counterclockwise direction 703 so that a user may respectively begin exercising either the left side of the body or the right side of the body. In one non-limiting embodiment, a user may selectively rotate counterclockwise along arcuate direction 703 by rotating chair assembly 734 in arcuate direction 703 (as best seen in FIG. 19) until rotator assembly 744 engages connecting rod 749 (i.e., connection rod 749 is in a locking condition with rotator assembly 744), while rotator assembly 745 also engages connecting rod 710, thereby causing connecting rod 749 to be coupled to actuator arm assembly 750 and further causing connecting rod 710 to be coupled to actuator arm assembly 750. Thus, seat frame 735 of seat assembly 734 is coupled to actuator arm assembly 750 at the anterior end 743 of frame 735, and seat frame 735 is also coupled to actuator arm assembly 770 at posterior end 748 of frame 735. It should be appreciated that, upon completion of coupling seat assembly 734 to the actuator arm assembly 750, the leg separator pad 742 is located at axis 811, and which is in a position that places substantially no "torsional" force (i.e., the rotational force exerted by the chair assembly on user's body).

Next, the user may selectively rotate seat assembly 734 to a comfortable beginning position in order to begin an exercise on apparatus 700. That is, user would rotate seat assembly 734 in a clockwise direction along arc 704 until leg separator pad 742 is aligned along axis 812, and where axis 812 forms an angle 813 with axis 811, and this rotation causes actuator arm assembly 750 to move in direction 815 while actuator arm assembly 770 being coupled to actuator rotator assembly 745 cause rotator arm assembly 770 to move in direction 814. It should be appreciated that a user may selectively rotate along arc 704 to any desired angle 813 in order to position his/her body in a comfortable position. It should also be appreciated that, upon completion of a user rotating his/her body, the users back is abutting back support pad 801 while his/her feet are lightly touching the ground.

Next, the user may selectively reach towards and grasp the respective actuator arm assemblies 750, 770 by respectively grasping grip portion 771, 787. Upon completion of the user grasping the handle grip portions 771, 787, the user is ready to begin utilizing the exercise apparatus 700.

Next, the user of the apparatus may selectively push upon handle grip 771 in direction 815, which causes actuator arm assembly 750 to apply a "pulling" force on rod 749 in direction 814, thereby applying a force on seat assembly 734 causing seat assembly 734 to rotate along arcuate direction 703, while concomitantly causing the user's lower body to move in direction of arc 703. Thus a force being applied to the rod 749 causes the rod 749 to pull the seat assembly 734, and forces the seat assembly 734 to rotate in a direction along arc 703, and which causes a torsional force to be applied to a users lower body at a users abdomen.

Next, the user would exercise his abdomen and his arms during a "positive" cycle of the apparatus 700 by gently resisting the rotational movement of the seat assembly 734 (i.e., by applying a "resistive" force on the seat assembly 734) and gently rotating the users abdomen from axis 812 to axis 811 along arc 703 while concomitantly holding onto the respective handle grips 771, 787, and which causes a "torsional" force (i.e., a rotational force) to be applied to the users abdomen by the rotation of seat assembly 734 along arc 703.

Next, the user would exercise his abdomen and his arms during a "negative' cycle of the apparatus 700 by removing the force applied to the respective handle grips 771, 787 (i.e., by not pushing or pulling on handle grips 771, 787), and rotating seat assembly 734 from position along axis 811 to axis 812 along direction of arc 703, thereby causing the seat assembly 734 to return to the beginning position of the exercise (i.e., at a position where no torsional force is applied on a users abdomen). It should be appreciated that a user may repeat as many of the "positive" and corresponding "negative" cycles as the user desires in order to strengthen user muscles in order to improve strength and flexibility. It should also be appreciated that the user's upper body (i.e., chest, arms, back, and the like) will also benefit from the apparatus 700 while reducing the risks associated of injuring the user during conventional resistance training.

Figure 22:
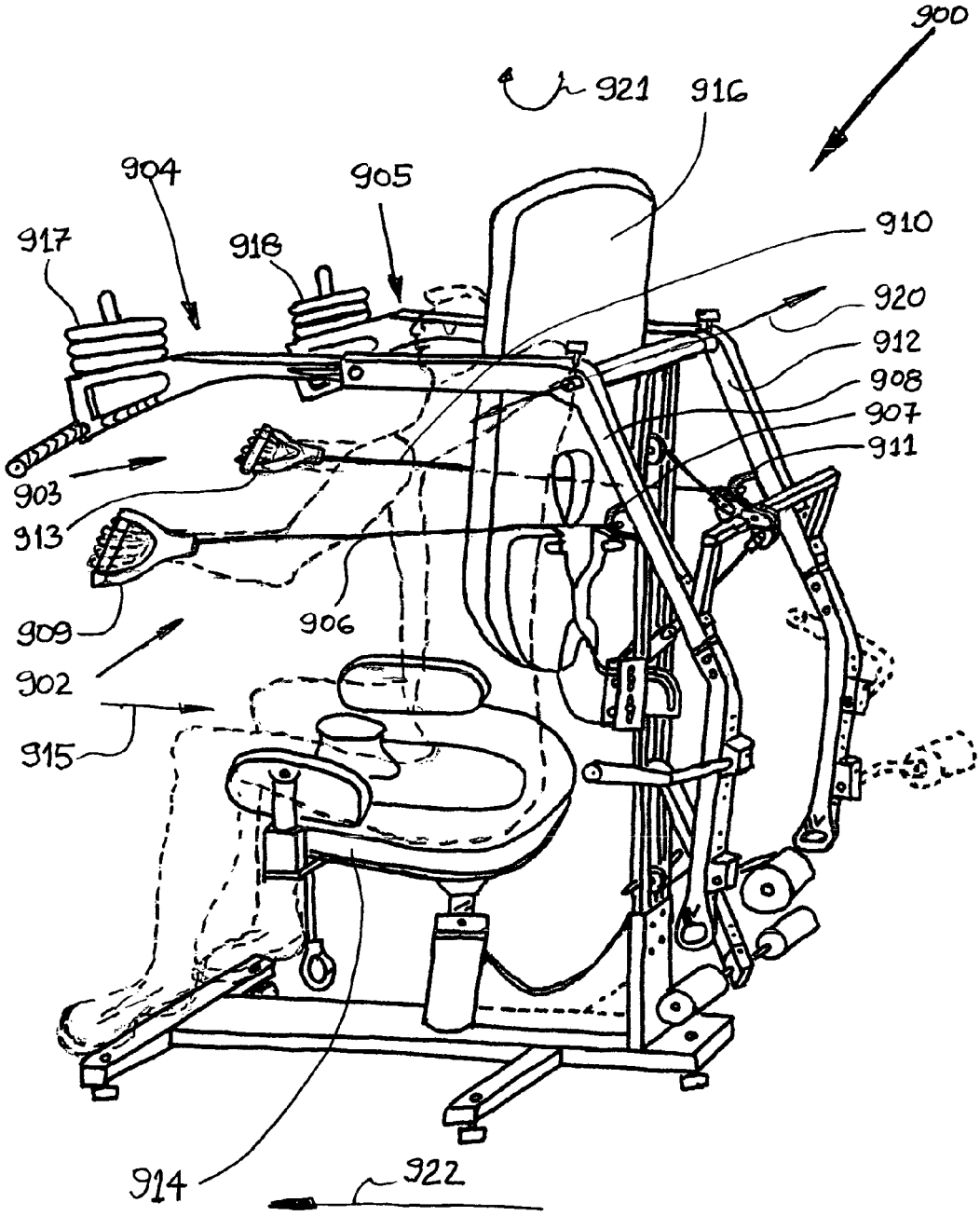
FIG. 22 is a perspective view of an exercise apparatus which is made in accordance with the teachings of yet another alternate embodiment of the invention.

In yet another alternate, although non-limiting, embodiment as is best perhaps shown in FIG. 22, exercise apparatus 900 comprises a plurality of substantially similar cable assemblies 902, 903 coupled to respective actuator arm assemblies 904, 905 while all other aspects of the exercise apparatus 900 remain the same as exercise apparatus 10 of the preferred embodiment, as was shown and described in FIGS.

1-2. Particularly, cable assembly 902 comprises a cable 906 coupled at one end to a hook portion 907, which is coupled to generally planar portion 908 of actuator arm assembly 904, and cable 906 being coupled at second end to a generally "O-shaped" handle member 909. Similarly, cable assembly 903 comprises a substantially similar cable 910 coupled at one end to a hook portion 911, which is coupled to generally planar portion 912 of actuator arm assembly 905, and cable 910 being coupled at second end to a generally "O-shaped" handle member 913. It should be appreciated that cable 906 is substantially the same length as cable 910 of cable assembly 903 and cables 906, 910 have a length which is smaller than the length of a users arms in a fully extended position. In operation, a user would utilize the exercise apparatus 900 as a "bench press" machine by placing the user's buttocks on buttocks pad 914 of seat assembly 915 so that the users back is abutting back support pad 916. Next the user would grasp respective handle members 909, 913 of respective cable assemblies 902, 903 and extend his arms (i.e., by opposing respective weights 917, 918), which causes respective cables 906, 910 to be "flexed". The flexing of cables 906, 910 causes respective cables 906, 910 to apply a force on respective portions 908, 912 (such as the force applied y cables 906, 910 pulling on respective portions 908, 912 in direction 922), thereby effective to cause respective actuator arm assemblies 904, 905 to rotate along arcuate about pivot axis 920 in arcuate direction 921. It should be appreciated that the user may selectively increase the resistance of the exercise apparatus 900 by selectively increasing the weights 917, 918 resting on actuator arm assemblies 903, 904.

It should be understood that this invention is not limited to the exact construction or embodiments listed and described, but that various changes may be made without departing from the spirit and scope of the invention.

What is claimed is:

1. An exercise apparatus comprising:

a rigid base frame assembly having a center rail, a base rail, and a plurality of side rails;

a first vertical beam coupled to said rigid base frame assembly;

a second pair of vertical beams, wherein said second pair of vertical beams are coupled to said first vertical beam;

a horizontal frame member which is coupled to said second pair of vertical beams, and wherein said horizontal frame member being remote from said first vertical beam;

a selectively movable back pad assembly mounted upon said second pair of vertical beams;

a selectively rotatable seat assembly coupled to said rigid base frame assembly, wherein said selectively rotatable seat assembly rotates about a first axis;

a pair of selectively movable first and second arm assemblies mounted upon said horizontal frame member, and wherein said selectively movable first and second arm assemblies pivot about a second axis, wherein a movement of said selectively movable first and second arm assemblies in a first direction causes said seat assembly to rotate in a second direction, thereby effective to cause seat assembly to exercise a users abdomen.

2. The exercise apparatus of claim 1 further comprising a pair of handle members coupled to said pair of actuator arm assemblies.

3. The exercise apparatus of claim 2 further comprising a cable having a first end coupled to said selectively rotatable seat assembly, and a second end coupled to one of said pair of selectively movable arm assemblies.

4. The exercise apparatus of claim 2 further comprising a pair of first and second rotator striker assemblies coupled to said first and second actuator arm assemblies.

5. The exercise apparatus of claim 2 further comprising a first coiled spring assembly coupled to said first arm assembly, and a second coiled spring assembly coupled to said second arm assembly, wherein a movement of said first coiled spring assembly in a first direction causes said coiled spring assembly to apply a force on said first arm assembly and a movement of said second coiled spring assembly in a second direction causes said second coiled spring assembly to apply a force on said second arm assembly.

6. An exercise chair for use in an office, said exercise chair comprising:

a rigid base frame assembly having a center rail, a base rail, and top rail;

a pair of independently and selectively rotatable first and second arm assemblies, wherein said pair of independently and selectively rotatable first and second arm assemblies pivot about a first axis;

a first vertical beam coupled to said rigid base frame assembly;

a second pair of vertical beams coupled to said first vertical beam;

a selectively movable back pad assembly mounted upon said second pair of vertical beams;

a selectively rotatable seat assembly coupled to said rigid base frame assembly, wherein said selectively rotatable seat assembly rotates about a second axis;

a pair of rotator striker assemblies coupled to said seat assembly, and wherein said pair of rotator striker assemblies further comprising a pair of connecting rods coupled to said pair of independently and selectively rotatable arm assemblies, wherein a movement of said selectively rotatable first arm assembly in a first direction causes said seat assembly to rotate in a second direction, and wherein a movement of said selectively rotatable second arm assembly in a first direction causes said seat assembly to rotate in a second direction, thereby effective to alternate movement of said first and second arm assemblies in order to exercise a users abdomen in a tensile mode.

7. A method for exercising an individual in a tensile mode, said method comprising the steps of:

providing a rigid base frame assembly having a center rail, a base rail, and a plurality of side rails;

providing a first vertical beam and coupling said first vertical beam to said rigid base frame assembly;

providing a plurality of second and third vertical beams, and coupling said plurality of second and third vertical beams to said first vertical beam;

providing a horizontal pivot member and coupling said horizontal pivot member to said plurality of second and third vertical beams;

providing a selectively movable back pad assembly and mounting said selectively movable back pad assembly upon said plurality of first and second vertical beams;

providing a selectively rotatable seat assembly and coupling said selectively seat assembly to said rigid base frame assembly;

providing a plurality of selectively movable first and second arm assemblies, and mounting said plurality of selectively movable first and second arm assemblies upon said horizontal frame member;

permitting said individual to sit in said seat assembly and abutting said individual's back against said back pad assembly;

rotating said seat assembly to a first position, wherein said individual's legs are close to said second and third vertical beams, and causing said individual to rotate said individual's back to a first position;

providing a cable and coupling said cable to one of said plurality of first and second arm assemblies;

rotating said seat assembly to a second position, wherein said individual's legs are remote from said second and third vertical beams, thereby lifting said plurality of first and second actuator arm assemblies;

grasping said first actuator arm assembly with a left hand and grasping a second actuator assembly with a right hand;

pulling upon said plurality of first and said second actuator assemblies, thereby applying a force on a users abdomen;

rotating said abdomen from said first position to a second position, thereby applying a torsion force on said abdomen;

releasing said plurality of first and second actuator arm assemblies and moving said abdomen from said second position to said first position.

* * * * *